US007100388B2

(12) United States Patent
Kim et al.

(10) Patent No.: US 7,100,388 B2
(45) Date of Patent: Sep. 5, 2006

(54) FRONT SUCTION/DISCHARGE TYPE COMPRESSOR/CONDENSER UNIT FOR AIRCONDITIONER

(75) Inventors: In-Gyu Kim, Jinhae-Shi (KR); Young-Ju Bae, Changwon-Shi (KR); Jae-Hyung Koo, Changwon-Shi (KR); Byung-Il Park, Changwon-Shi (KR); Kyeong-Ho Kim, Changwon-Shi (KR); Yang-Ho Kim, Changwon-Shi (KR); Young-Ho Hong, Kimhae-Shi (KR); Kyeong-Wook Heo, Changwon-shi (KR); Kang-Wook Cha, Changwon-shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/250,364

(22) PCT Filed: Apr. 18, 2003

(86) PCT No.: PCT/KR03/00794

§ 371 (c)(1),
(2), (4) Date: Jul. 1, 2003

(87) PCT Pub. No.: WO03/073010

PCT Pub. Date: Sep. 4, 2003

(65) Prior Publication Data

US 2004/0163402 A1 Aug. 26, 2004

(30) Foreign Application Priority Data

Feb. 26, 2003 (KR) ..... 10-2003-0012099
Feb. 26, 2003 (KR) ..... 10-2003-0012098

(51) Int. Cl.
*F25D 23/12* (2006.01)

(52) U.S. Cl. ..... 62/259.1; 62/263; 62/305

(58) Field of Classification Search ..... 62/259.1, 62/263, 277, 279, 305, 428, 429, 507
See application file for complete search history.

(56) References Cited

U.S. PATENT DOCUMENTS

| | | | | |
|---|---|---|---|---|
| 5,255,969 A | | 10/1993 | Cox et al. | 312/236 |
| 6,155,065 A | * | 12/2000 | da Silva | 62/262 |
| 2002/0157415 A1 | | 10/2002 | Liu | 23/12 |

FOREIGN PATENT DOCUMENTS

| | | | | |
|---|---|---|---|---|
| EP | 1248049 A2 | * | 10/2002 | 62/429 |
| JP | 54-18043 | | 2/1979 | |
| JP | 03-213928 | | 9/1991 | |
| JP | 06-101873 | | 4/1994 | |
| KR | 2002-0097379 | | 12/2002 | |

* cited by examiner

*Primary Examiner*—Melvin Jones
(74) *Attorney, Agent, or Firm*—Fleshner & Kim LLP

(57) ABSTRACT

The present invention relates to a front suction/discharge type outdoor unit for an air conditioner to provide an economical installation structure for efficiently installing a large capacity outdoor unit and provide services for easily transferring the outdoor unit, and examining, exchanging and repairing its components, by separating a suction casing and a discharge casing. The front suction/discharge type outdoor unit includes an outdoor unit suction casing having its one surface externally opened, and sucking external air for heat exchange, and an outdoor unit discharge casing being separated from or coupled to the outdoor unit suction casing, sucking external air through the outdoor unit suction casing, having its one surface externally opened, and discharging heat exchanged external air. Here, opened surfaces are respectively formed in the outdoor unit suction casing and the outdoor unit discharge casing to connect them to discharge the sucked external air.

51 Claims, 23 Drawing Sheets

FRONT SUCTION/DISCHARGE TYPE COMPRESSOR/CONDENSER UNIT FOR AIRCONDITIONER

TECHNICAL FIELD

The present invention relates to an outdoor unit for an air conditioner, and more particularly to, a front suction/discharge type outdoor unit for an air conditioner which can be easily installed, managed and repaired.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication No. 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between the louver plates.

In addition, Japanese Laid-Open Patent Publication No. 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

However, air conditioning capacity has recently gradually increased. Differently from the general outdoor unit, a front suction/discharge type outdoor unit restricts an air suction/discharge direction. Therefore, additional components and installation structures are required to restrict the suction/discharge direction, which increases a volume and weight of the front suction/discharge type outdoor unit. As a result, it is difficult to carry and install the front suction/discharge type outdoor unit. However, there has never been suggested a structure of an outdoor unit which can overcome such disadvantages.

Moreover, when the outdoor unit having great volume and weight is incorporated as in the related art, the whole outdoor unit casing must be separated or disassembled in order to manage, examine and repair its components.

In addition, when the front suction/discharge type outdoor unit is built in the wall, a lot of expenses and manpower are needed to separate or disassemble the external casing.

DISCLOSURE OF THE INVENTION

An object of the present invention is to provide an economical installation structure for efficiently installing a large capacity outdoor unit and also provide services for easily transferring the outdoor unit, and examining, exchanging and repairing its components, by converting capacity of the outdoor unit sucking air from three sides and discharging it to a top surface into a front suction/discharge type, and separating a suction casing and a discharge casing.

Another object of the present invention is to provide separable side separating covers for an outdoor unit to easily examine, exchange and repair components of the outdoor unit.

In order to achieve the above-described objects of the invention, there is provided a front suction/discharge type outdoor unit for an air conditioner, including: an outdoor unit suction casing having its one surface externally opened, and sucking external air for heat exchange; and an outdoor unit discharge casing being separated from or connected to the outdoor unit suction casing, sucking external air through the outdoor unit suction casing, having its one surface externally opened, and discharging heat exchanged external air, wherein opened surfaces are respectively formed in the outdoor unit suction casing and the outdoor unit discharge casing to connect them to discharge the sucked external air.

Here, the outdoor unit suction casing preferably includes the opened top surface, one opened surface, a closed bottom surface and three sides, the outdoor unit discharge casing includes the opened bottom surface connected to the opened top surface of the outdoor unit suction casing, one opened surface, a closed top surface and three sides, and one opened surface of the outdoor unit suction casing and one opened surface of the outdoor unit discharge casing face the outside in the same direction.

Preferably, a coupling member for coupling or separating the outdoor unit suction casing to/from the outdoor unit discharge casing is additionally used. The coupling member includes: internal flanges protruded from the ends of at least two sides of the outdoor unit suction casing and the outdoor unit discharge casing to the inside of the outdoor unit; a hook formed on the surface of one internal flange; and a guide hole formed on the surface of the other internal flange. Here, the guide hole preferably has a circular hole which the hook is firstly inserted into, and a rectangular hole which the hook is slid into. Preferably, the two sides of the outdoor unit suction casing and the outdoor unit discharge casing are not adjacent to each other.

Preferably, the coupling member further includes: external flanges being protruded from the ends of the sides where the internal flanges of the outdoor unit suction casing and the outdoor unit discharge casing have been formed to the outside of the outdoor unit, and having a predetermined number of openings corresponding to each other; and bolts and nuts for connecting the outdoor unit suction casing to the outdoor unit discharge casing through the openings of the external flanges. The nuts are preferably studs adhered to one of the surfaces of the external flanges of the outdoor unit suction casing and the outdoor unit discharge casing.

Preferably, the coupling member includes: external flanges being protruded from the ends of at least two sides of the outdoor unit suction casing and the outdoor unit discharge casing to the outside of the outdoor unit, and having a predetermined number of openings corresponding to each other; and bolts and nuts for connecting the outdoor unit suction casing to the outdoor unit discharge casing through the openings of the external flanges. The nuts are preferably studs adhered to one of the surfaces of the external flanges of the outdoor unit suction casing and the outdoor unit discharge casing, and the two sides of the outdoor unit suction casing and the outdoor unit discharge casing are not adjacent to each other.

Preferably, the coupling member includes: external flanges protruded from the ends of at least two sides of the outdoor unit suction casing and the outdoor unit discharge casing; a hook formed on the surface of one external flange; and a guide hole formed on the surface of the other external flange. The guide hole is composed of a circular hole which the hook is firstly inserted into, and a rectangular hole which the hook is slid into. The coupling member further includes a screw for fastening the hook.

Preferably, the coupling member further includes: openings additionally formed on the external flange where the hook has been formed; and bolts and nuts for connecting the outdoor unit suction casing to the outdoor unit discharge casing through the openings and the rectangular hole. A width of the rectangular hole is equal to or greater than a diameter of the nut, and the two sides of the outdoor unit suction casing and the outdoor unit discharge casing are not adjacent to each other.

Preferably, the coupling member further includes: openings formed on the external flanges to correspond to each other; and bolts and nuts for connecting the outdoor unit suction casing to the outdoor unit discharge casing through the openings. The nuts are preferably studs adhered to one of the surfaces of the external flanges of the outdoor unit suction casing and the outdoor unit discharge casing.

Preferably, handle members are respectively installed at the lower ends of the two sides of the outdoor unit discharge casing contacting one surface.

In addition, at least one surface of the outdoor unit discharge casing includes a side separating member connected from the outside to the inside of the outdoor unit discharge casing, and the side separating member includes an open hole formed on the surface, and a side separating cover for opening/closing the open hole.

Preferably, the outdoor unit further includes an insertion limiting member for inserting the side separating cover into the open hole at a predetermined depth, the insertion limiting member is a limiting plate formed at the inside of the open hole or the surface, and the outdoor unit casing further includes a cover coupling member for coupling the side separating cover to the surface where the open hole has been formed. In addition, the limiting plate includes a predetermined number of openings, the side separating cover includes openings corresponding to the openings of the limiting plate, the cover coupling member includes bolts and nuts for connecting the limiting plate to the side separating cover through the openings, and the nuts are studs adhered to the rear surface of the limiting plate.

Preferably, the insertion limiting member is a flange formed on at least one side of the side separating cover, the surface includes a predetermined number of openings adjacent to the open hole, the flange of the side separating cover includes openings corresponding to the openings of the surface, the cover coupling member includes bolts and nuts for connecting the surface to the side separating cover through the openings, and the nuts are studs adhered to the inside of the surface.

In addition, the outdoor unit casing includes a rotation coupling member for coupling the surface to one side of the side separating cover so that the side separating cover can rotate to open/close the open hole, and the rotation coupling member is a first or second hinge device which further includes a fixing member for fixing the side separating cover to the surface so that the rotated side separating cover can close the open hole.

According to another aspect of the invention, a front suction/discharge type outdoor unit for an air conditioner includes an outdoor unit casing having its one surface externally opened and its other surfaces closed, sucking external air for heat exchange, and discharging heat exchanged air through one surface, at least one of the other surfaces of the outdoor unit casing having a side separating member connected from the outside to the inside of the outdoor unit casing.

BEST MODE FOR CARRYING OUT THE INVENTION

Figure 1:
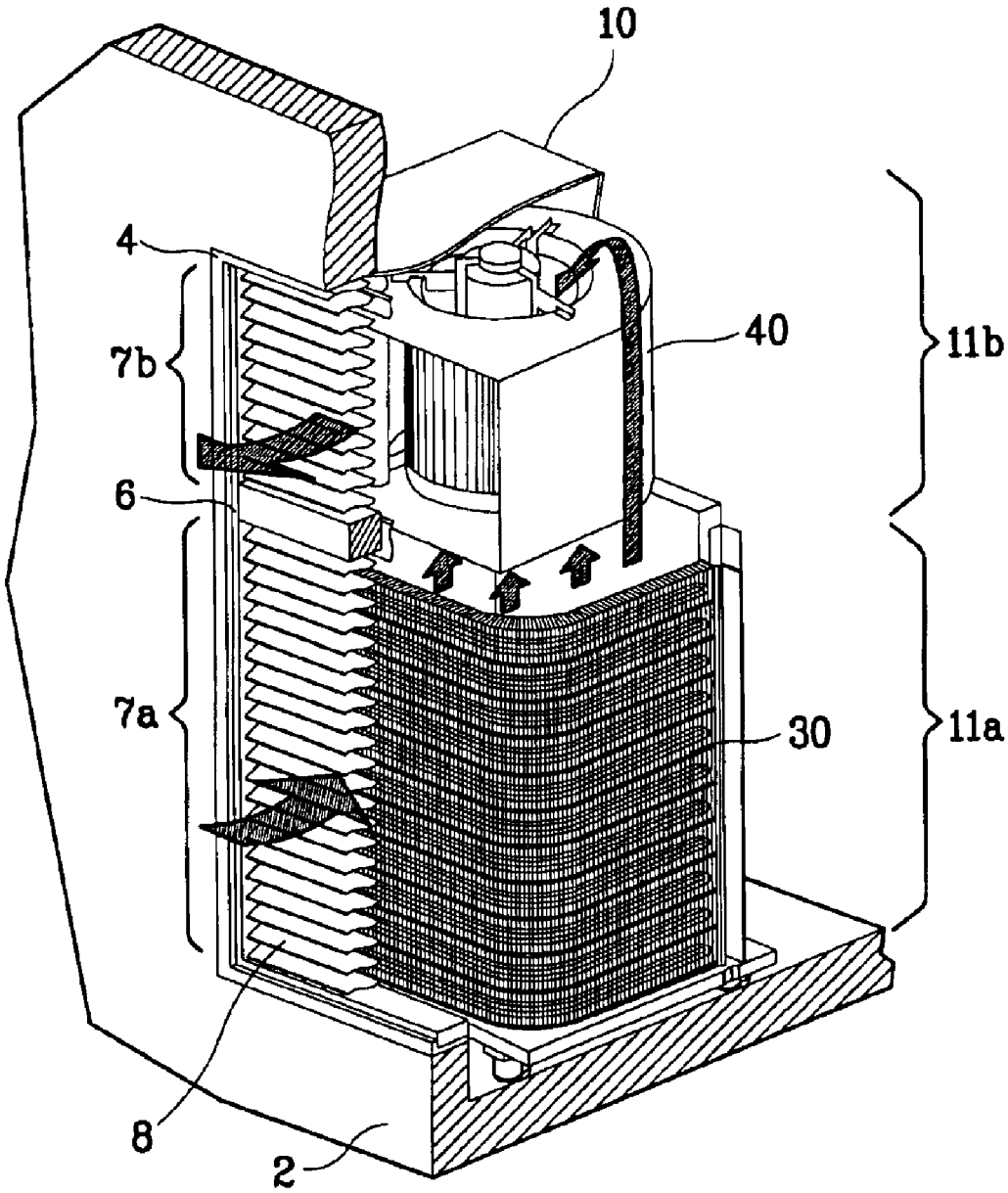
FIG. 1 is a partially-cut perspective-sectional view illustrating a front suction/discharge type outdoor unit for an air conditioner in accordance with a first embodiment of the present invention.
Figure 2:
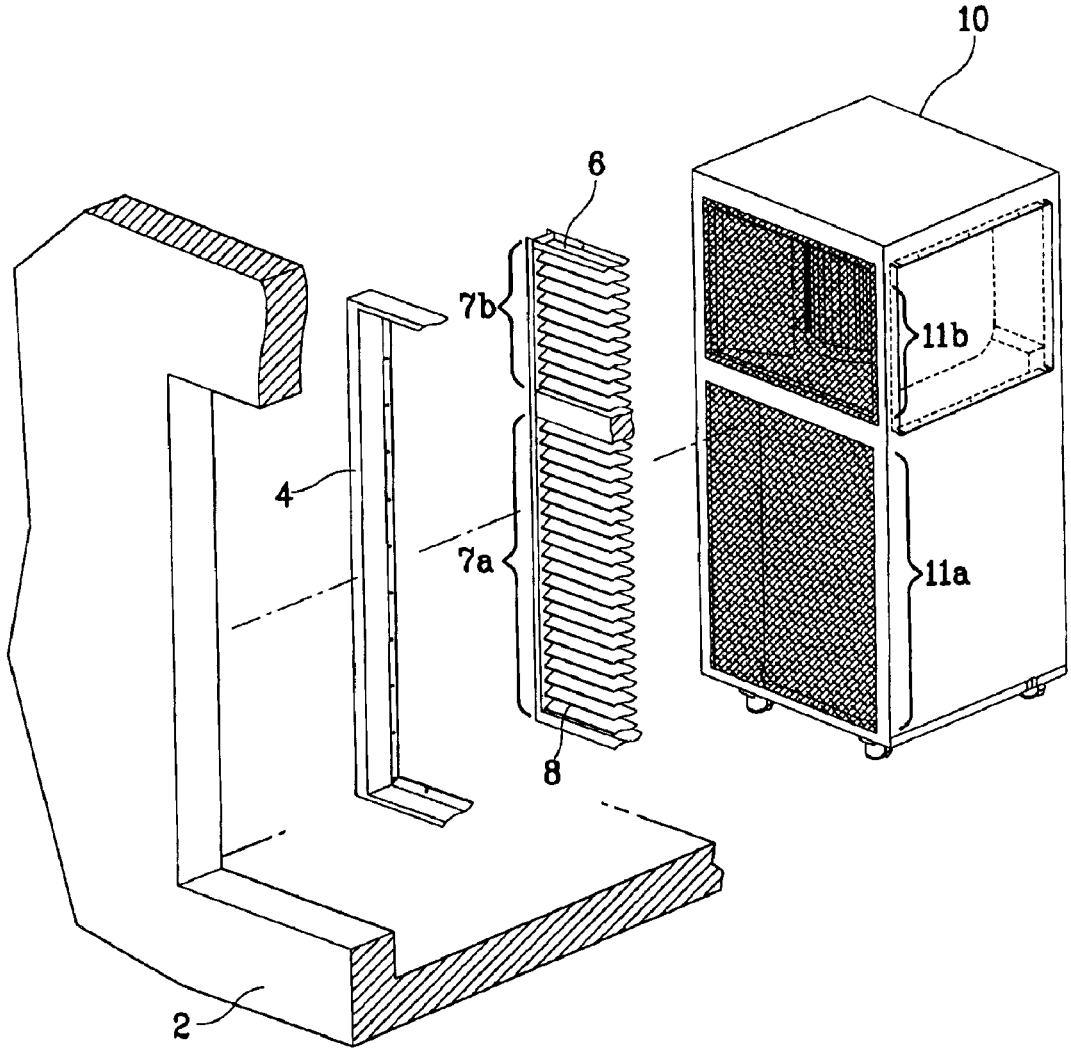
FIG. 2 is an exemplary view illustrating installation and assembly of the outdoor unit of FIG. 1.
Figure 3:
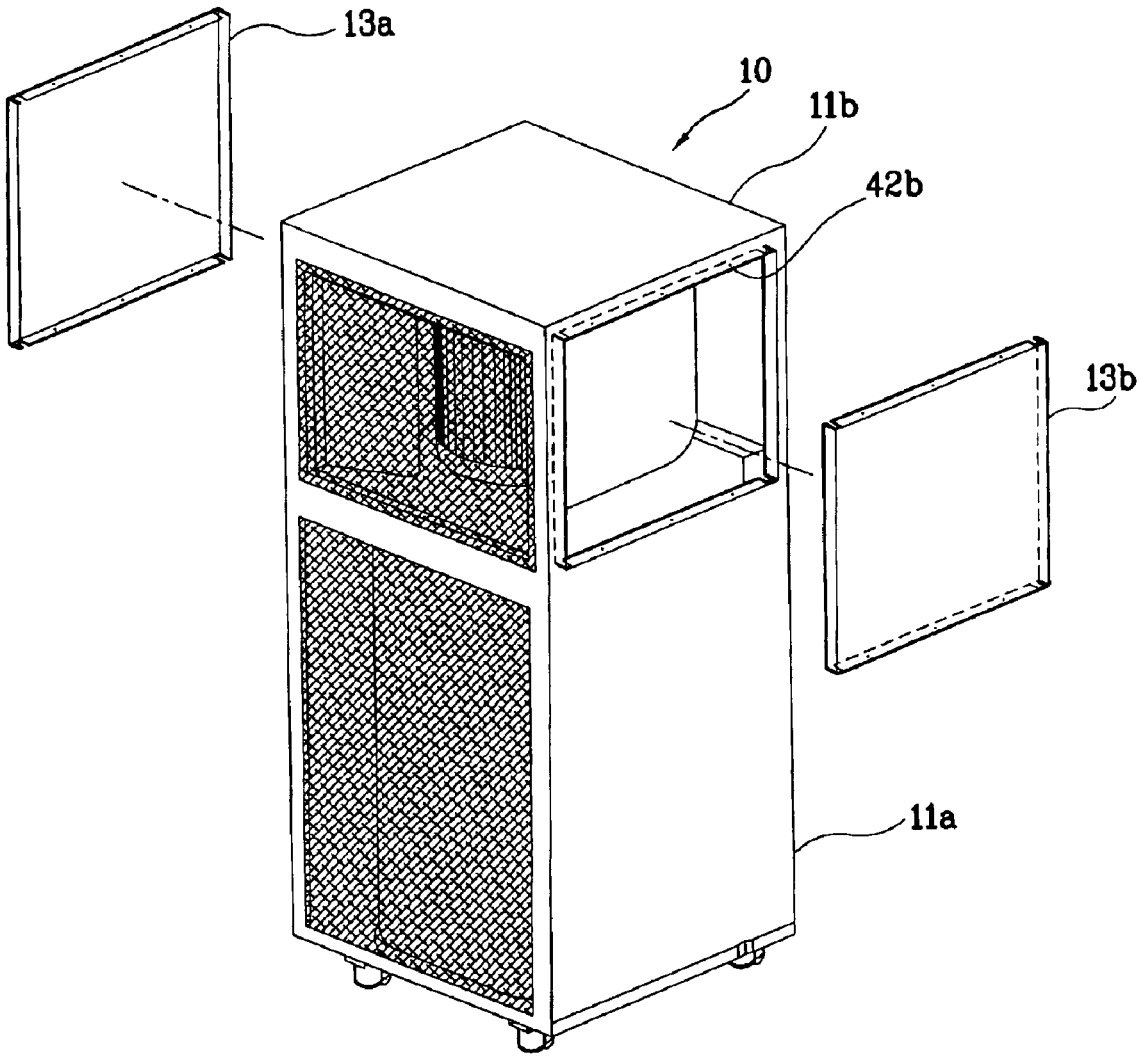
FIG. 3 is a perspective view illustrating the outdoor unit in a state where side separating covers are separated in FIG. 1.

A front suction/discharge type outdoor unit for an air conditioner in accordance with the present invention will now be described in detail with reference to the accompanying drawings.

FIGS. 1 through 4B are structure views illustrating the front suction/discharge type outdoor unit for the air conditioner in accordance with a first embodiment of the present invention.

An external frame 4 is fixedly installed on a rectangular space inner wall formed on an outer wall 2 of a residential and/or commercial building, and an internal frame 6 is fixedly installed at the other side of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8.

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades are easily understood by ordinary people skilled in the art to which the present invention pertains. It is also possible to determine the air suction/discharge direction in consideration of an external environment, and to open and maintain the louver blades 8 in a predetermined direction.

Figure 4A:
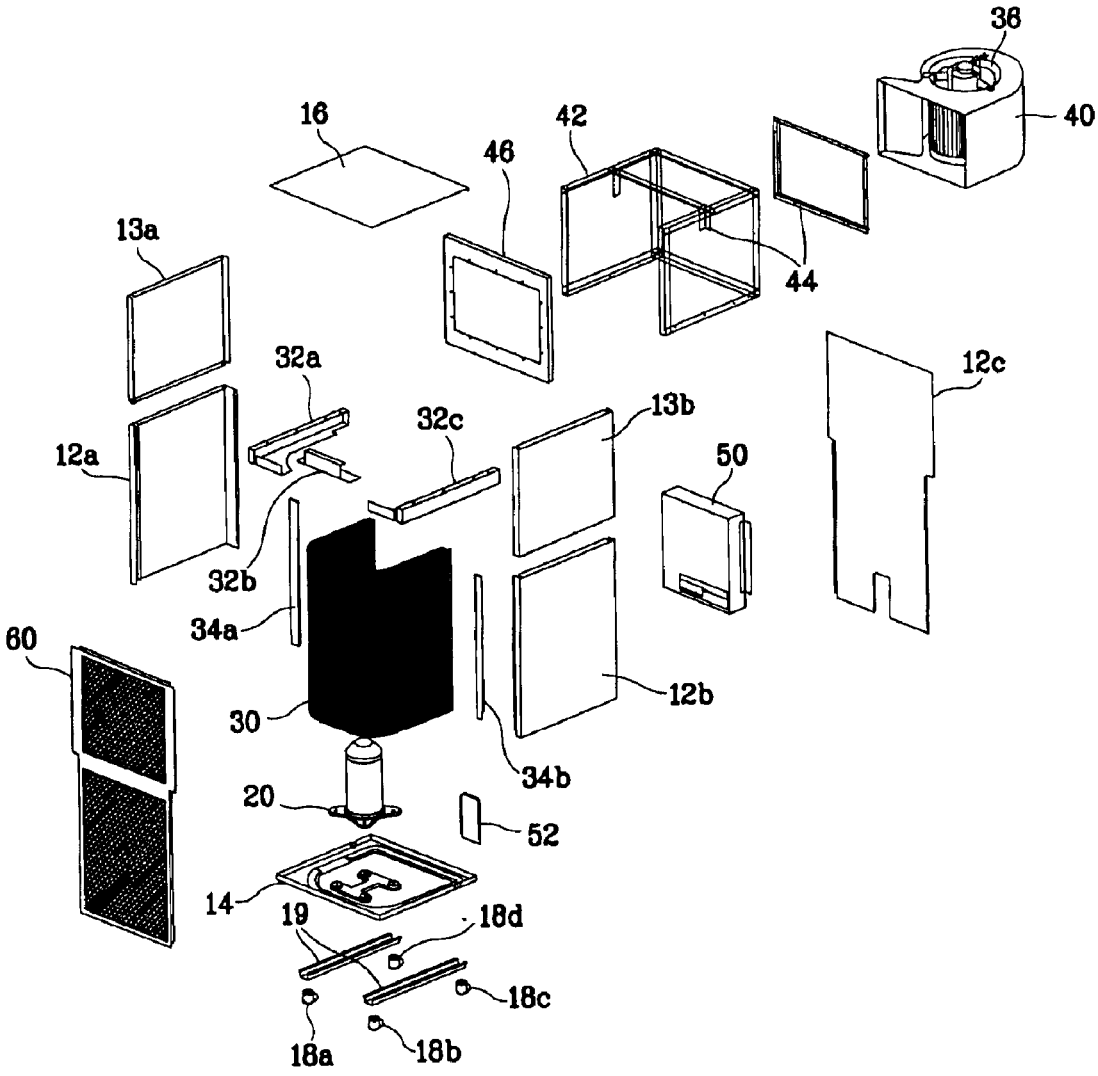
FIG. 4A is a perspective view illustrating disassembly of the outdoor unit of FIG. 1.

On the other hand, the outdoor unit 10 fixedly installed at the inside of the outer wall 2 of the building to contact the external frame 4 and/or internal frame 6 includes an outdoor unit casing composed of components of FIG. 4A. In addition, outdoor unit components of FIG. 4A are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, lower side covers 12*a*, 12*b* and 12*c*, side separating covers 13*a* and 13*b* separable from the discharge unit 11*b*, a bottom cover 14 and a top cover 16 are closed to form a rectangular parallelepiped. The side separating covers 13*a* and 13*b* can be separated from open holes 42*a* and 42*b* (42*a* is not shown) formed at the right and left sides of the outdoor unit 10. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. A leg reinforcing member 19 for connecting and reinforcing the leg members 18*a*, 18*b*, 18*c* and 18*d* is formed below the bottom cover 14 in the horizontal direction. The leg members 18*a*, 18*b*, 18*c* and 18*d* further include bolts (not shown) for controlling height. Accordingly, when the bottom of the building, for example the veranda of the apartment building is not flat, they can stably position the outdoor unit 10. When the two legs 18*a* and 18*b* positioned in the forward direction (toward building outer wall) among the leg members 18*a*, 18*b*, 18*c* and 18*d* further include transfer wheels (not shown), it is much easier to transfer the heavy load outdoor unit 10.

In the outdoor unit suction unit 11*a*, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by externally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

In the outdoor unit discharge unit 11*b*, a cooling fan 40 for supplying external air to the air-cooled condenser 30 through the suction area 7*a*, and discharging heat exchanged air through the discharge area 7*b* is fixedly installed on the top cover 16 by a cooling fan supporting member 42 and a cooling fan bracket 44. The side separating covers 13*a* and 13*b* closing the right and left sides of the outdoor unit discharge unit 11*b* are mounted separable from the cooling fan supporting member 42 or the left side. When the services for examining, exchanging or repairing the components are required, the side separating covers 13*a* and 13*b* are separated from the cooling fan supporting member 42 or the right and left sides, and the outdoor unit discharge unit 11*b* is opened to receive such services. Here, the open holes 42*a* and 42*b* can be one side of the cooling fan supporting member 42, or formed in another right and left side covers (not shown), namely smaller than the right and left side covers, and the side separating covers 13*a* and 13*b* can open/close the open holes 42*a* and 42*b* formed in the right and left side covers.

One example of the cooling fan 40 is a sirocco fan. In the sirocco fan of FIG. 4A, one of suction orifices 36 is farthest from the suction unit 11*a* and faces the top surface 16 contacting one opened side, and the other orifice faces the suction unit 11*a*. Therefore, as indicated by arrows of FIG. 1, air sucked through one side is heat exchanged in the suction unit 11*a*, transmitted to the sirocco cooling fan 40 in the upper and lower directions, and then discharged.

Figure 4B:
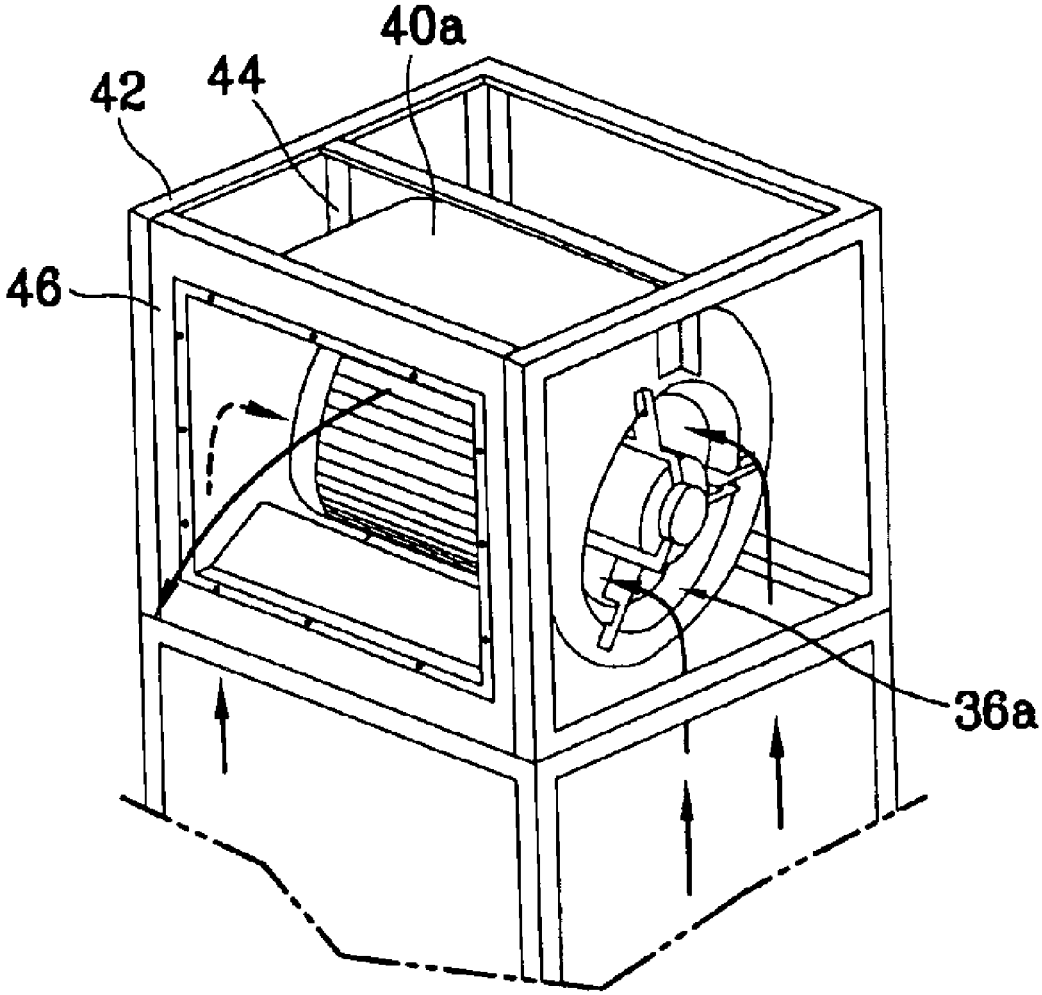
FIG. 4B is a partial perspective view illustrating another example of a cooling fan of FIG. 4A.

As shown in FIG. 4B, in the sirocco cooling fan 40*a*, the suction orifices 36*a* can be aligned not to contact each other and to respectively face the side separating covers 13*a* and 13*b* contacting one opened side. Accordingly, as indicated by arrows of FIG. 4B, air sucked through one side is heat exchanged in the suction unit 11*a*, sucked in the right and left directions of the sirocco cooling fan 40*a*, and then discharged. In addition, the side separating covers 13*a* and 13*b* are separated from the discharge unit 11*b* to directly expose motor parts of the sirocco fan 40*a*, so that they can be easily cleaned, repaired and examined.

As described above, the side separating covers 13*a* and 13*b* of the invention can be applied to the various cooling fans 40 and 40*a* installed in the discharge unit 11*b*.

Reference numeral 46 denotes a fan front installed in front of the cooling fan 40.

A control box 50 for controlling the operation of the outdoor unit 10 is installed at the inside of the side cover 12*c* composing the rear surface, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

A mesh shaped front grill 60 is additionally installed on the front surface of the outdoor unit 10, namely one side facing the suction area 7*a* and the discharge area 7*b* of the internal frame 6 to prevent invasion of animals (for example, rats).

Figure 5A:
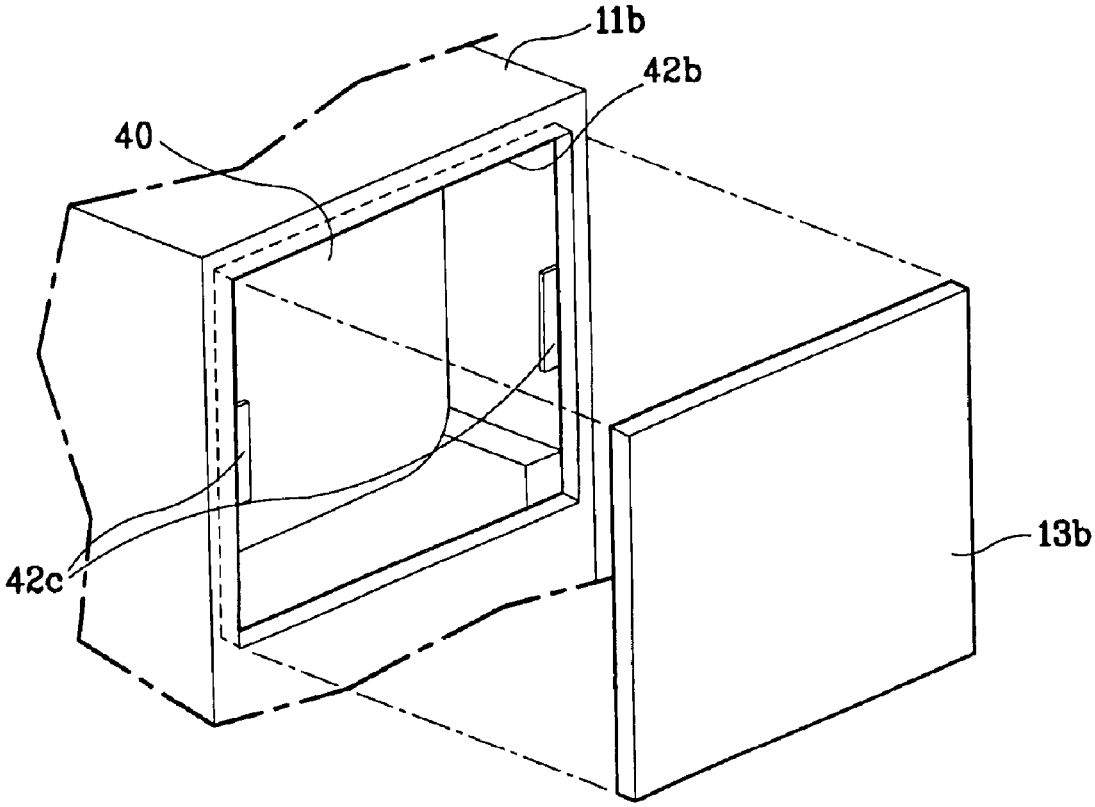
FIGS. 5A and 5B are perspective views illustrating an insertion limiting member in accordance with first and second embodiments of the present invention.

FIG. 5A is a perspective view illustrating an insertion limiting member in accordance with a first embodiment of the present invention. As illustrated in FIG. 5A, the discharge unit 11*b* of the outdoor unit 10 includes the open hole 42*b* in at least one side, and the side separating cover 13*b* opens/closes the open hole 42*b* for external access to the discharge unit 11*b*. However, an insertion depth must be restricted to prevent the side separating cover 13*b* from being completely inserted into the open hole 42*b* or unevenly positioned to the surface of the suction unit 11*a*. Thus, at least one limiting plate 42*c* which is an insertion limiting member is formed at one side of the open hole 42*b* to appropriately insert the side separating cover 13*b* into the open hole 42*b*.

Figure 5B:
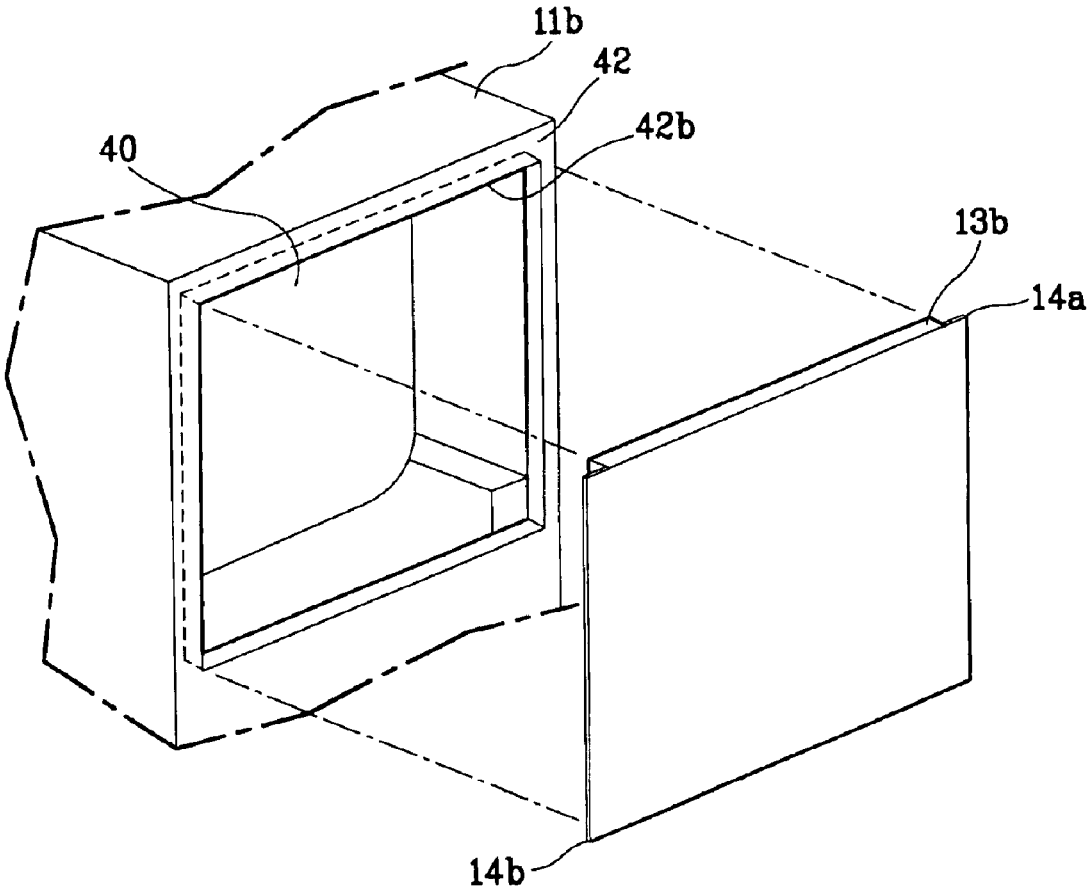

FIG. 5B is a perspective view illustrating an insertion limiting member in accordance with a second embodiment of the present invention. As depicted in FIG. 5B, at least one flange 14*a* and 14*b* which is an insertion limiting member is formed at one side of the open hole 42*b* to appropriately insert the side separating cover 13*b* into the open hole 42*b*.

Figure 6A:
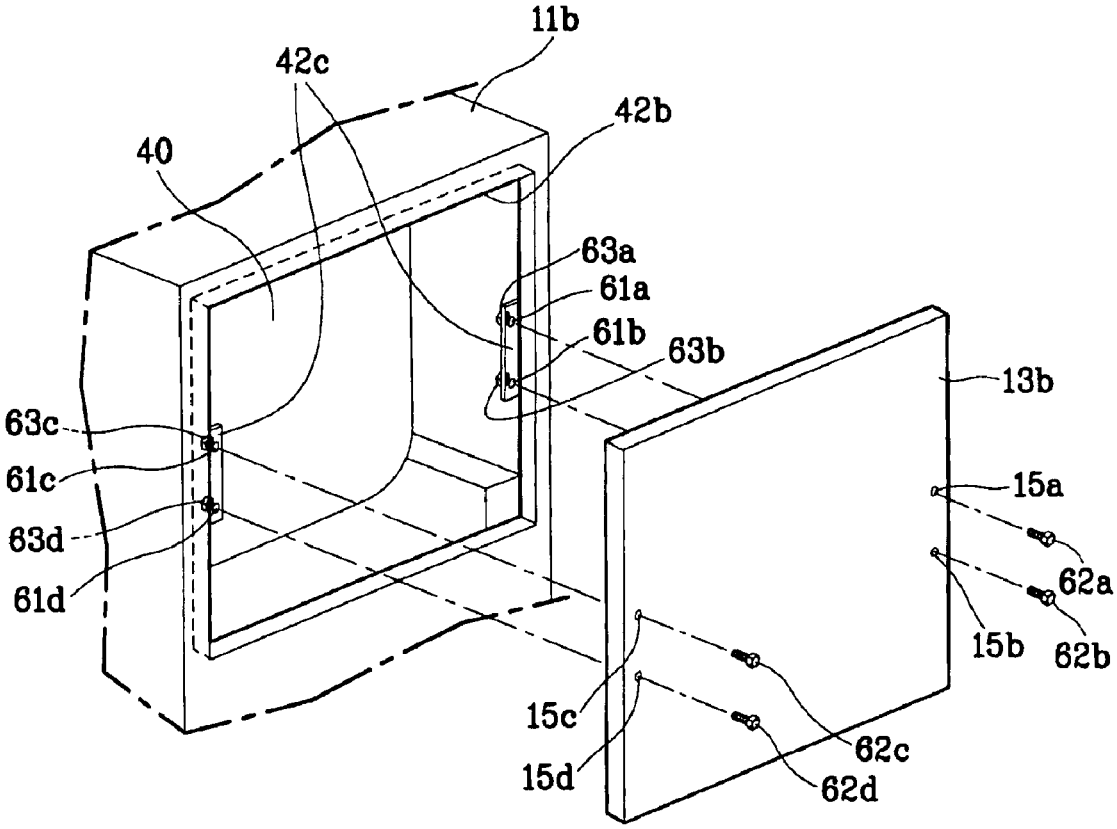
FIGS. 6A and 6B are perspective views illustrating a cover coupling member in accordance with first and second embodiments of the present invention.

FIG. 6A is a perspective view illustrating a cover coupling member in accordance with a first embodiment of the present invention. FIG. 6A illustrates the cover coupling member inserted and coupled to the open hole 42*b* for preventing external alien substances or noise, when the side separating cover 13*b* opens/closes the open hole 42*b* as shown in FIG. 5A. The cover coupling member of FIG. 6A includes openings 15*a*, 15*b*, 15*c* and 15*d* formed in at least one side of the side separating cover 13*b* corresponding to the limiting plate 42*c*, openings 61*a*, 61*b*, 61*c* and 61*d* formed on the limiting plate 42*c* to correspond to the openings 15*a*, 15*b*, 15*c* and 15*d* of the side separating cover 13*b*, and bolts 62*a*, 62*b*, 62*c* and 62*d* and nuts 63*a*, 63*b*, 63*c* and 63*d* for connecting the side separating cover 13*b* to the right side of the discharge unit 11*b* through the openings 15*a*, 15*b*, 15*c*, 15*d*, 61*a*, 61*b*, 61*c* and 61*d*. Here, the nuts 63*a*, 63*b*, 63*c* and 63*d* can be studs adhered to the rear surface of the limiting plate 42.

Figure 6B:
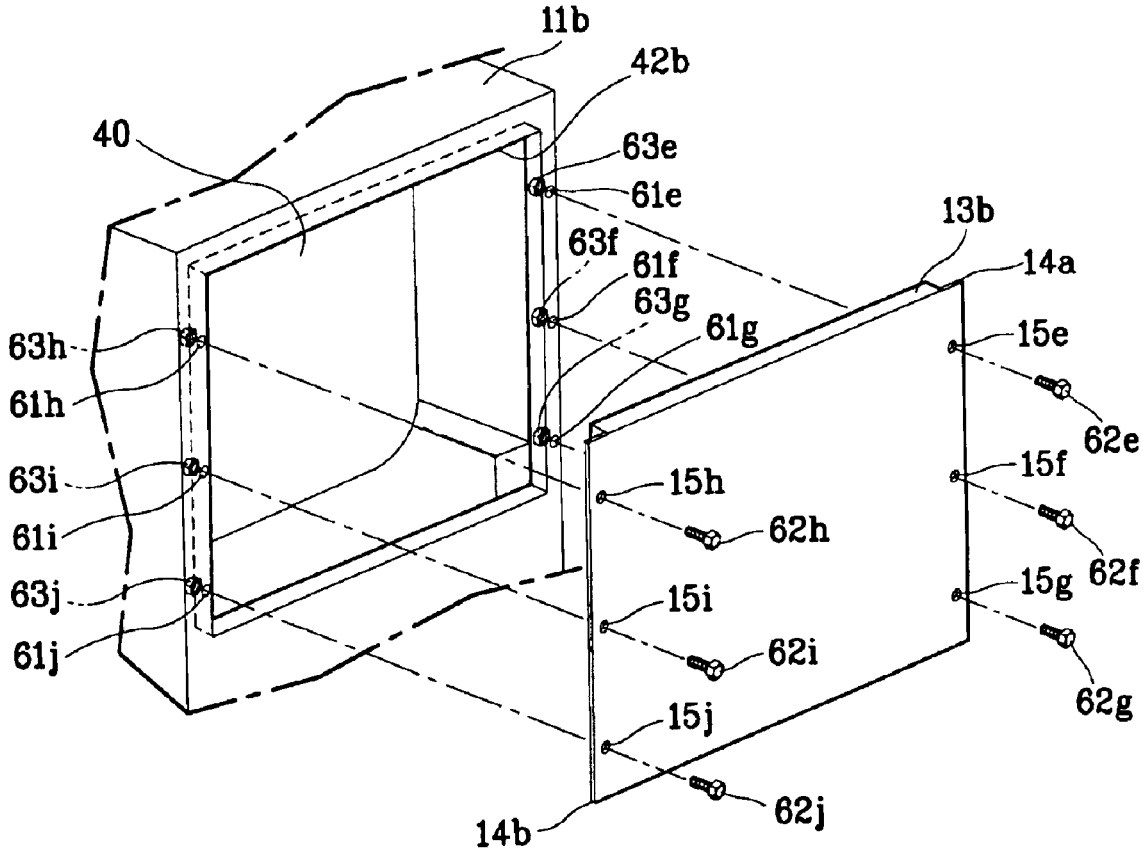

FIG. 6B is a perspective view illustrating a cover coupling member in accordance with a second embodiment of the present invention. The embodiment of FIG. 6B requires the cover coupling member due to the same reason as FIG. 6A. The cover coupling member includes openings 15*e*, 15*f*, 15*g*, 15*h*, 15*i* and 15*j* formed on the flanges 14*a* and 14*b* of the side separating cover 13*b*, openings 61*e*, 61*f*, 61*g*, 61*h*, 61*i* and 61*j* formed adjacently to the open hole 42*b* to correspond to the openings 15*e*, 15*f*, 15*g*, 15*h*, 15*i* and 15*j* of the flanges 14*a* and 14*b*, and bolts 62*e*, 62*f*, 62*g*, 62*h*, 62*i* and 62*j* and nuts 63*e*, 63*f*, 63*g*, 63*h*, 63*i* and 63*j* for connecting the side separating cover 13*b* to the right side of the discharge unit 11*b* through the openings 15*e*, 15*f*, 15*g*, 15*h*, 15*i*, 15*j*, 61*e*, 61*f*, 61*g*, 61*h*, 61*i* and 61*j*. Here, the nuts 63*e*, 63*f*, 63*g*, 63*h*, 63*i* and 63*j* can be studs adhered to the right and left sides of the discharge unit 11*b*.

FIGS. 7A to 7D are perspective views illustrating a rotation coupling member in accordance with first to fourth embodiments of the present invention.

Figure 7A:
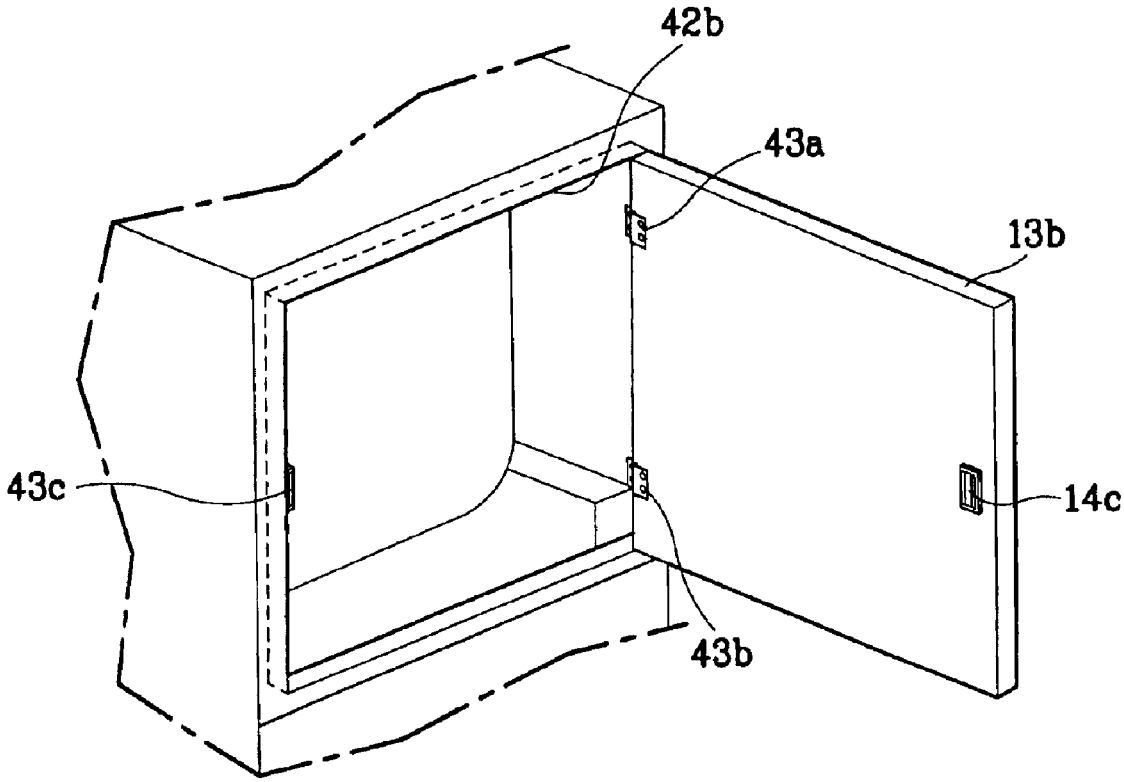
FIGS. 7A to 7D are perspective views illustrating a rotation coupling member in accordance with first to fourth embodiments of the present invention.

Referring to FIG. 7A, the rotation coupling member including one or more first hinge devices 43*a* and 43*b* adhered respectively to one side of the side separating cover 13*b* and one side of the surface on which the open hole 42*b* of the discharge unit 11*b* has been formed enables the rotatable side separating cover 13*b* to open/close the open hole 42*b*.

Figure 7B:
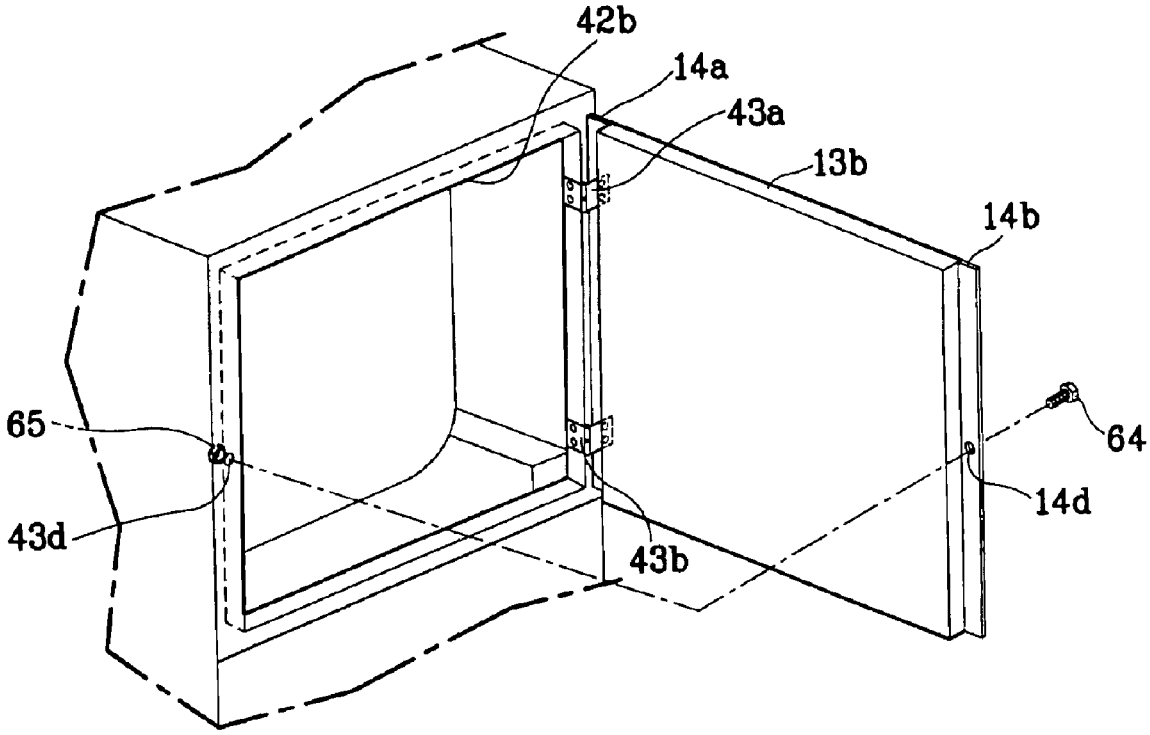

FIG. 7B is a perspective view illustrating a rotation coupling member in accordance with the second embodiment of the present invention. The rotation coupling member including one or more first hinge devices 43*a* and 43*b* adhered respectively to one of the flanges 14*a* and 14*b* formed in at least one side of the side separating cover 13*b* and one side of the surface on which the open hole 42*b* of the discharge unit 11*b* has been formed enables the rotatable side separating cover 13*b* to open/close the open hole 42*b*. A fixing member includes an opening 14*d* formed on another flange 14*b* of the side separating cover 13*b*, an opening 43*d* formed on the surface of the discharge unit 11*b* to correspond to the opening 14*b*, and a bolt 64 and a nut 65 for connecting the side separating cover 13*b* to the discharge unit 11*b* through the openings 14*d* and 43*d*, so that the side separating cover 13*b* can continuously close the open hole 42*b*. Here, the nut 65 can be a stud adhered to the inside of the surface of the discharge unit 11*b*.

Figure 7C:
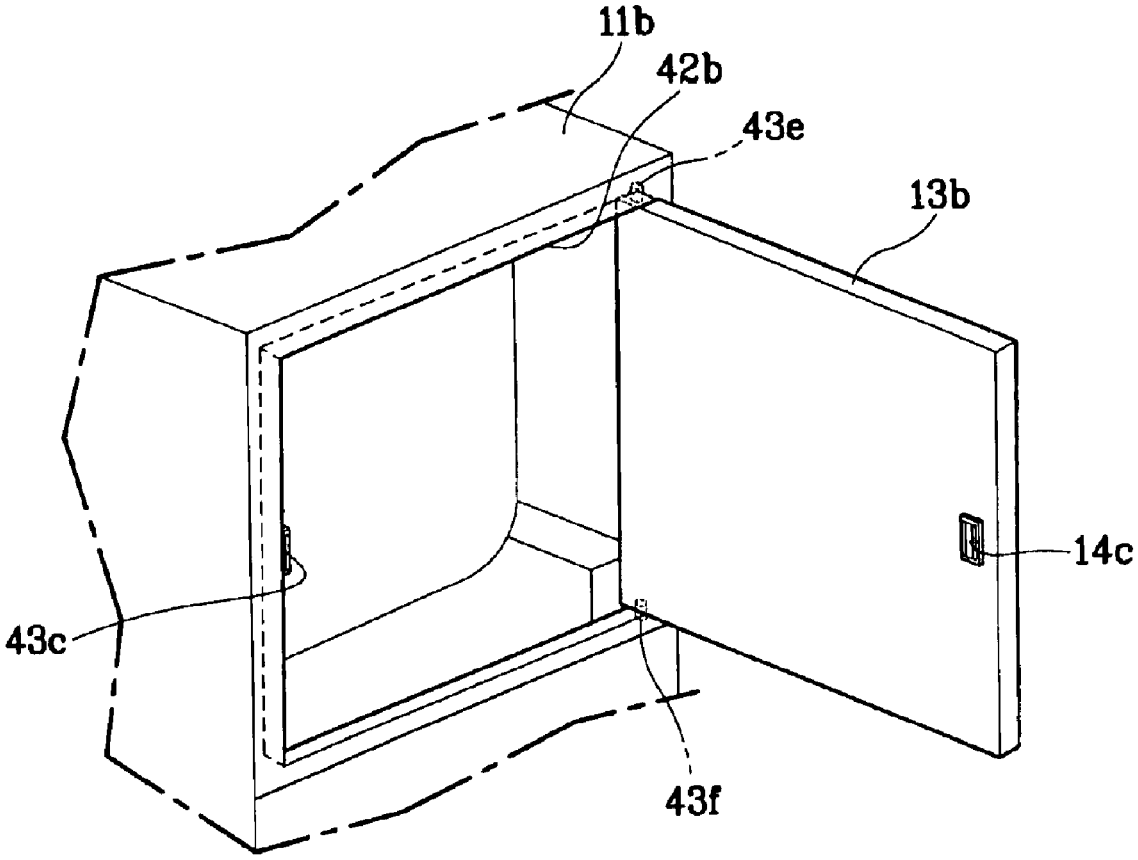

FIG. 7C is a perspective view illustrating a rotation coupling member in accordance with the third embodiment of the present invention. The rotation coupling member including one or more second hinge devices 43*e* and 43*f* adhered respectively to two sides of the side separating cover 13*b* and two sides of the open hole 42*b* of the discharge unit 11*b* enables the rotatable side separating cover 13*b* to open/close the open hole 42*b*. The side separating cover 13*b* can continuously close the open hole 42*b* by using a fixing member such as a magnet 14*c* adhered to its one side and a magnet 43*c* adhered to one side of the open hole 42*b*.

Figure 7D:
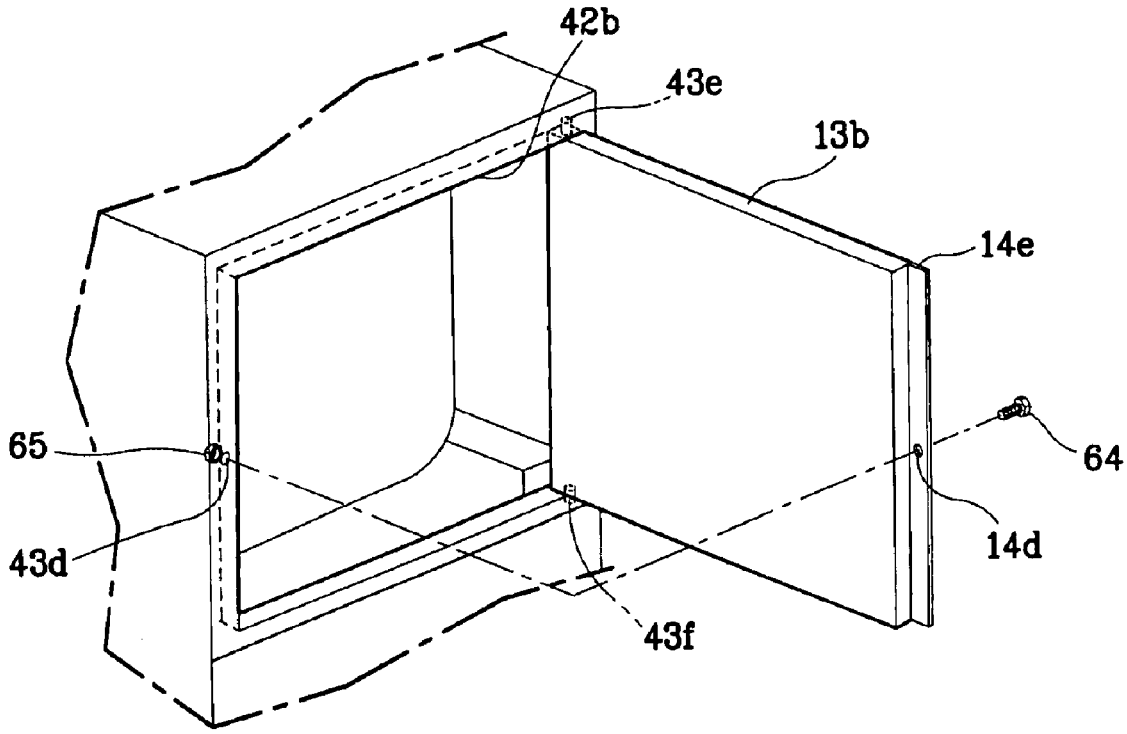

FIG. 7D is a perspective view illustrating a rotation coupling member in accordance with the fourth embodiment of the present invention. The rotation coupling member including one or more second hinge devices 43*e* and 43*f* adhered respectively to two sides of the side separating cover 13*b* and one side of the surface on which the open hole 42*b* of the discharge unit 11*b* has been formed enables the rotatable side separating cover 13*b* to open/close the open hole 42*b*. A fixing member includes an opening 14*d* formed on a flange 14*e* formed at one side of the side separating cover 13*b*, an opening 43*d* formed on the surface of the discharge unit 11*b* to correspond to the opening 14*d*, and a bolt 64 and a nut 65 for connecting the side separating cover 13*b* to the discharge unit 11*b* through and the openings 14*d* and 43*d*, so that the side separating cover 13*b* can continuously close the open hole 42*b*. Here, the nut 65 can be a stud adhered to the inside of the surface of the discharge unit 11*b*.

The fixing member is not restricted to the magnets, bolts and nuts, but can be variously transformed and modified.

Figure 8A:
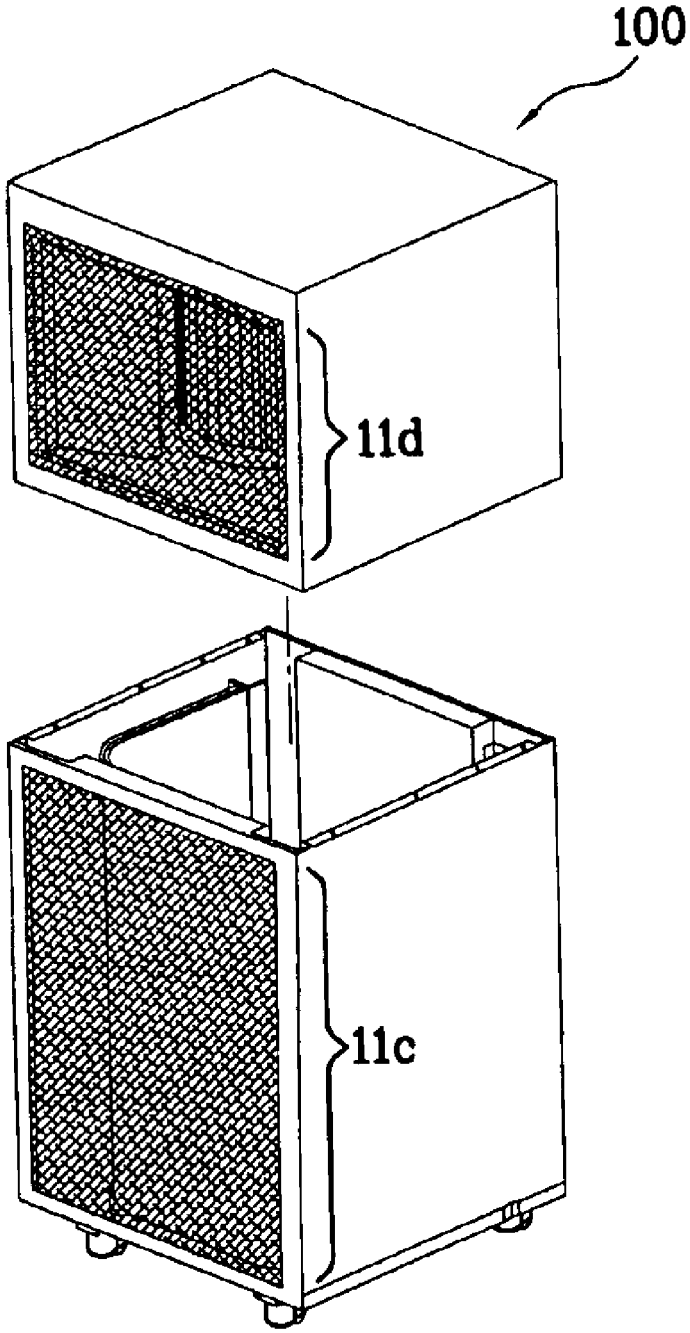
FIG. 8A is a state view illustrating separation of a front suction/discharge type outdoor unit for an air conditioner in accordance with a second embodiment of the present invention.
Figure 8B:
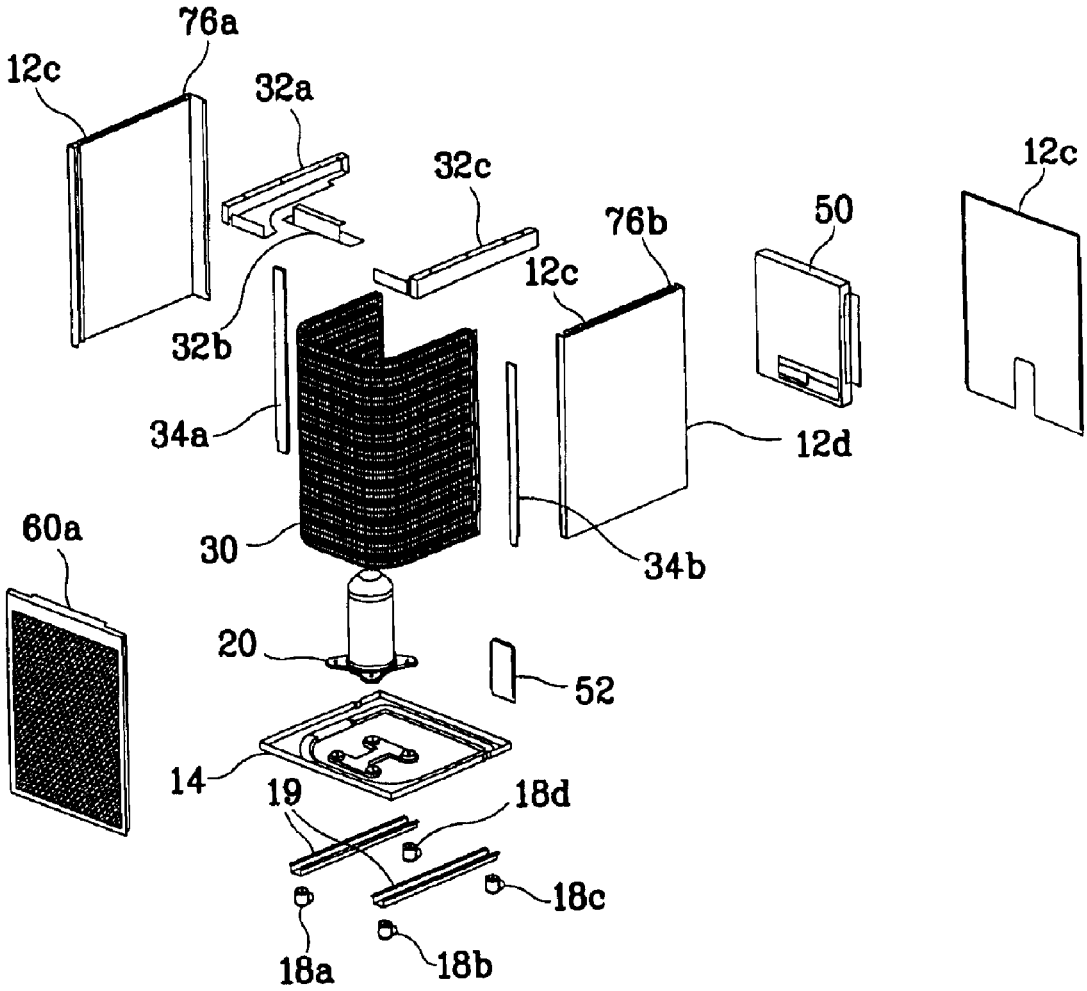
FIG. 8B is a perspective view illustrating disassembly of an outdoor unit suction casing of FIG. 8A.
Figure 8C:
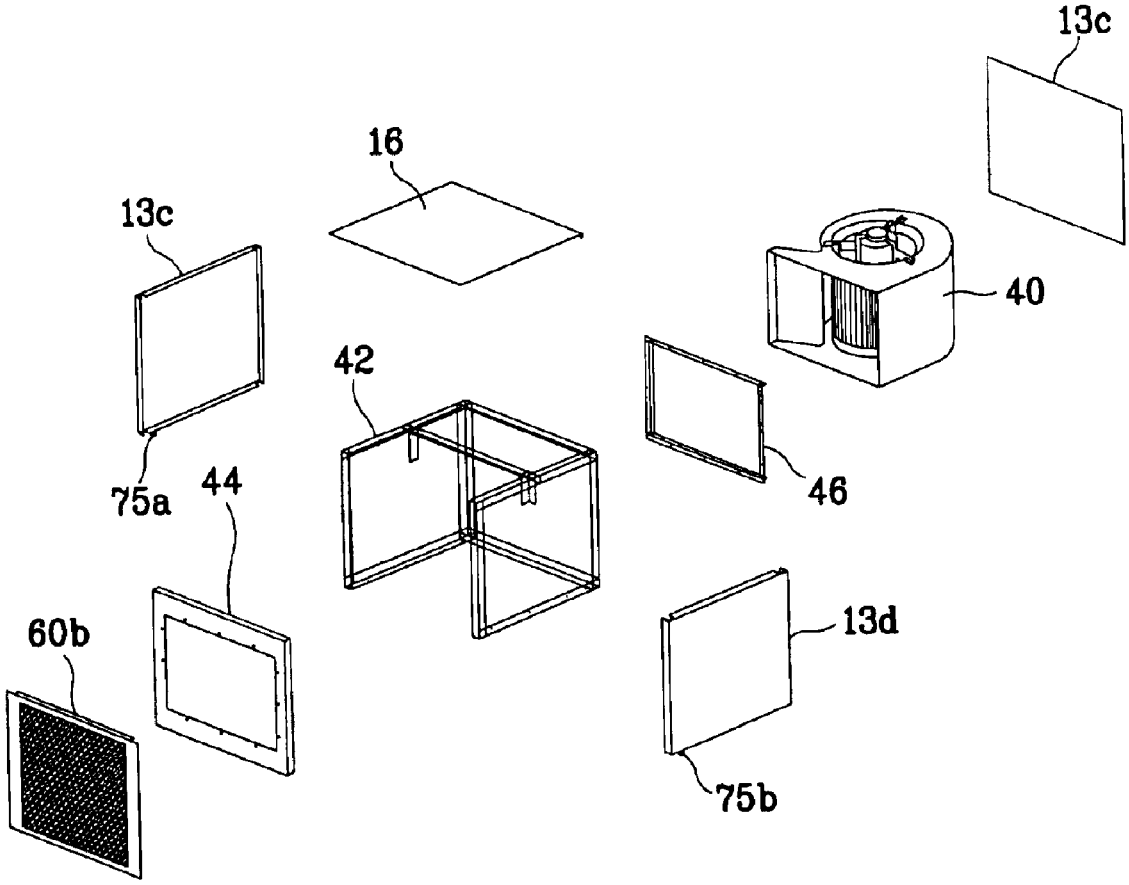
FIG. 8C is a perspective view illustrating disassembly of an outdoor unit discharge casing of FIG. 8A.

FIGS. 8A to 8C illustrate a front suction/discharge type outdoor unit for an air conditioner in accordance with a second embodiment of the present invention. Here, the outdoor unit 100 of the second embodiment has the same constitution as the outdoor unit 10 of the first embodiment except for the following elements.

The outdoor unit 100 includes a separable outdoor unit suction casing 11*c* and a separable outdoor unit discharge casing 11*d*. Here, the outdoor unit suction casing 11*c* corresponds to the suction unit 11*a* of the outdoor unit 10, and the outdoor unit discharge casing 11*d* corresponds to the discharge unit 11*b* of the outdoor unit 10.

Differently from the front grill 60 of the outdoor unit 10, the outdoor unit 100 includes two front grills 60*a* and 60*b*.

In addition, in order to couple the outdoor unit suction casing 11*c* to the outdoor unit discharge casing 11*d*, hooks 75*a* and 75*b* are installed on side covers 13*c* and 13*d* of the outdoor unit discharge casing 11*d*, and guide holes 76*a* and 76*b* are installed on side covers 12*c* and 12*d* of the outdoor unit suction casing 11*c*, which will later be explained in detail.

The outdoor unit 100 which can be separated/assembled reduces its whole weight and size to be easily transferred and moved. The outdoor unit 100 can also be easily installed by firstly installing the outdoor unit suction casing 11*c*, and then installing the outdoor unit discharge casing 11*d*. For management and repair, the outdoor unit 100 is partially separated and disassembled so that its inside components can be examined. That is, the outdoor unit 100 has a simplified structure in time and cost.

Figure 9A:
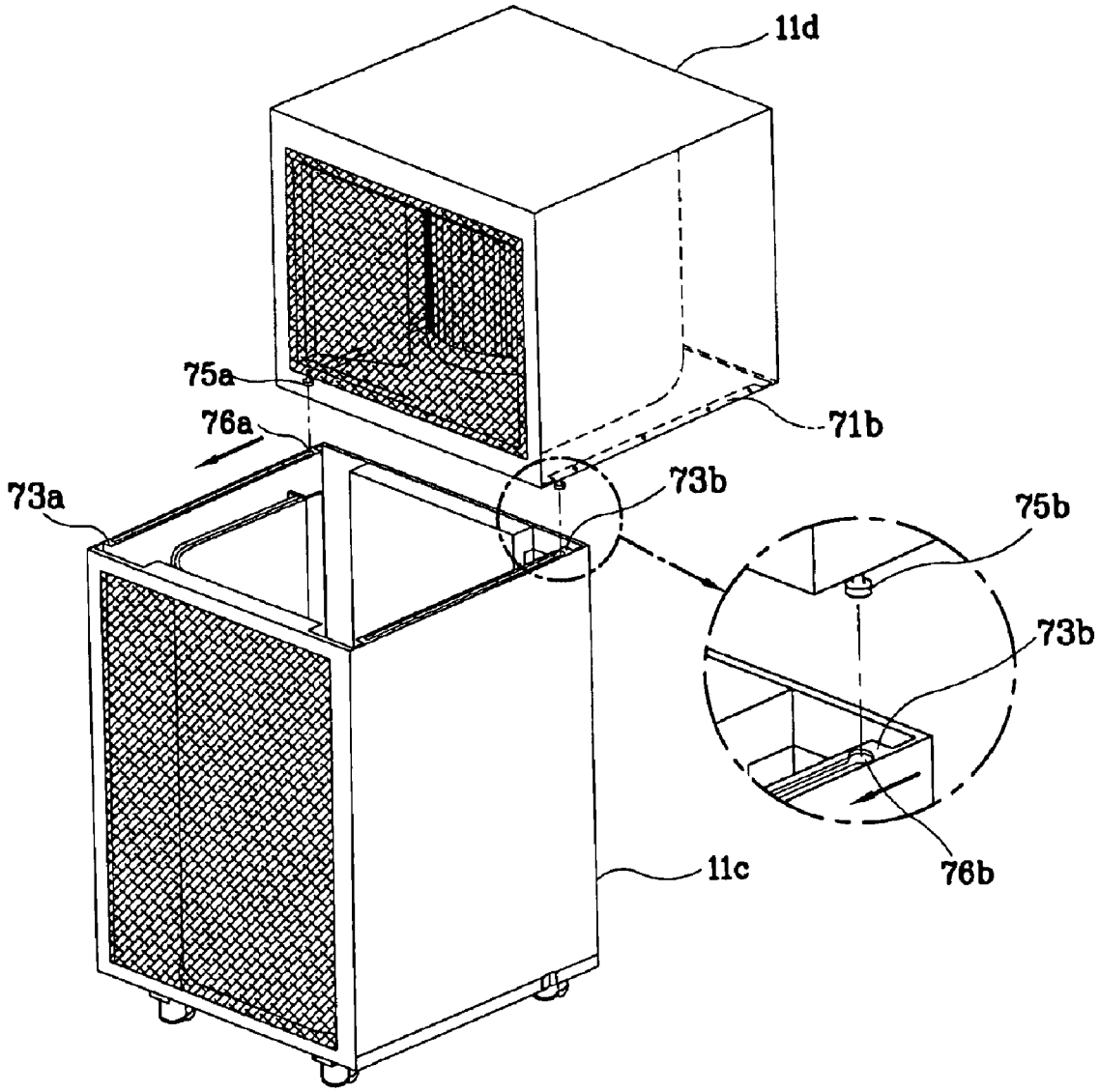
FIG. 9A is a perspective view illustrating a coupling member in accordance with a first embodiment of the present invention.

FIG. 9A is a perspective view illustrating a coupling member in accordance with a first embodiment of the present invention. As shown in FIG. 9A, internal flanges 71*a* and 71*b* (71*a* is not shown) are formed at one side of the side covers 13*c* and 13*d* formed on the bottom surface of the outdoor unit discharge casing 11*d*, the hooks 75*a* and 75*b* are installed on the surfaces of the internal flanges 71*a* and 71*b* to face the top surface of the outdoor unit suction casing 11*c*, internal flanges 73*a* and 73*b* are formed at one side of the side covers 12*c* and 12*d* formed on the top surface of the outdoor unit suction casing 11*c*, and the guide holes 76*a* and 76*b* corresponding to the hooks 75*a* and 75*b* are installed on the surfaces of the internal flanges 73*a* and 73*b*. The coupling member includes the hooks 75*a* and 75*b* and the guide holes 76*a* and 76*b*.

The guide holes 76*a* and 76*b* include circular holes which the hooks 75*a* and 75*b* are firstly inserted into, and rectangular holes which the hooks 75*a* and 75*b* are slid into.

Figure 9B:
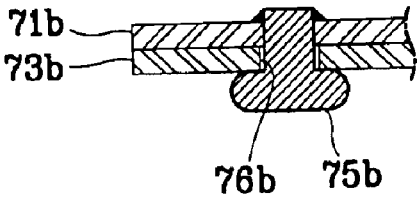
FIG. 9B is a partial cross-sectional view illustrating the coupling member of FIG. 9A.

FIG. 9B is a partial cross-sectional view illustrating the coupling member of FIG. 9A. As illustrated in FIG. 9B, the hook 75*b* adhered to the internal flange 71*b* is coupled to the guide hole 76*b* formed on the internal flange 73*b*, so that the outdoor unit suction casing 11*c* and the outdoor unit discharge casing 11*d* can be separated or coupled.

Figure 10A:
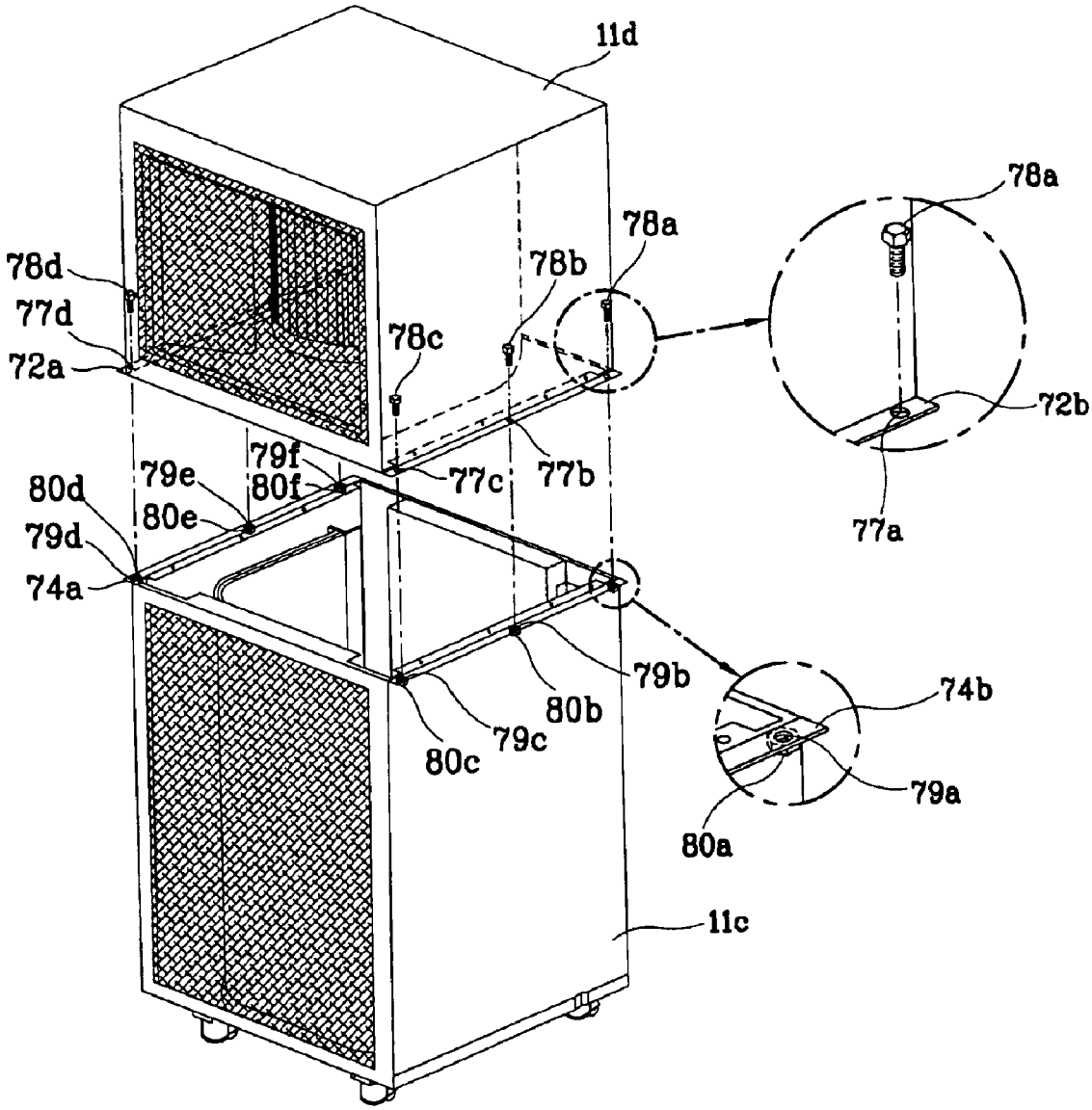
FIG. 10A is a perspective view illustrating a coupling member in accordance with a second embodiment of the present invention.

FIG. 10A is a perspective view illustrating a coupling member in accordance with a second embodiment of the present invention. As shown in FIG. 10A, externally-protruded external flanges 72*a* and 72*b* are formed at one side of the side covers 13*c* and 13*d* formed on the bottom surface of the outdoor unit discharge casing 11*d*, a predetermined number of openings 77*a*, 77*b*, 77*c*, 77*d*, 77*e* and 77*f* are formed on the external flanges 72*a* and 72*b*, externally-protruded external flanges 74*a* and 74*b* are formed at one side of the side covers 12*c* and 12*d* formed on the top surface of the outdoor unit suction casing 11*c*, a predetermined number of openings 79*a*, 79*b*, 79*c*, 79*d*, 79*e* and 79*f* are formed on the external flanges 74*a* and 74*b* to correspond to the openings 77*a*, 77*b*, 77*c*, 77*d*, 77*e* and 77*f*, and bolts 78*a*, 78*b*, 78*c*, 78*d*, 78*e* and 78*f* and nuts 80*a*, 80*b*, 80*c*, 80*d*, 80*e* and 80*f* connect the external flanges 72*a*, 72*b*, 74*a* and 74*b* through the openings 77*a*, 77*b*, 77*c*, 77*d*, 77*e*, 77*f*, 79*a*, 79*b*, 79*c*, 79*d*, 79*e* and 79*f*.

Figure 10B:
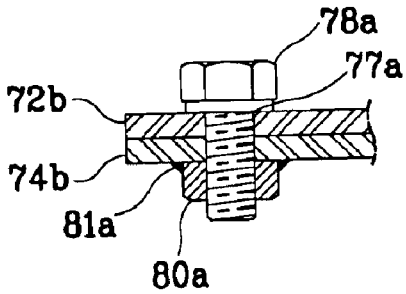
FIG. 10B is a partial cross-sectional view illustrating the coupling member of FIG. 10A.

FIG. 10B is a partial cross-sectional view illustrating the coupling member of FIG. 10A. As depicted in FIG. 10B, the bolt 78*a* passing through the openings 77*a* and 79*a* is separated from or coupled to the nut 80*a*, so that the outdoor unit suction casing 11*c* and the outdoor unit discharge casing 11*d* can be separated or coupled. Here, the nut 80*a* can be a stud fastened to the external flange 74*b* by using an adhering member 81*a* (for example, soldering).

Figure 11A:
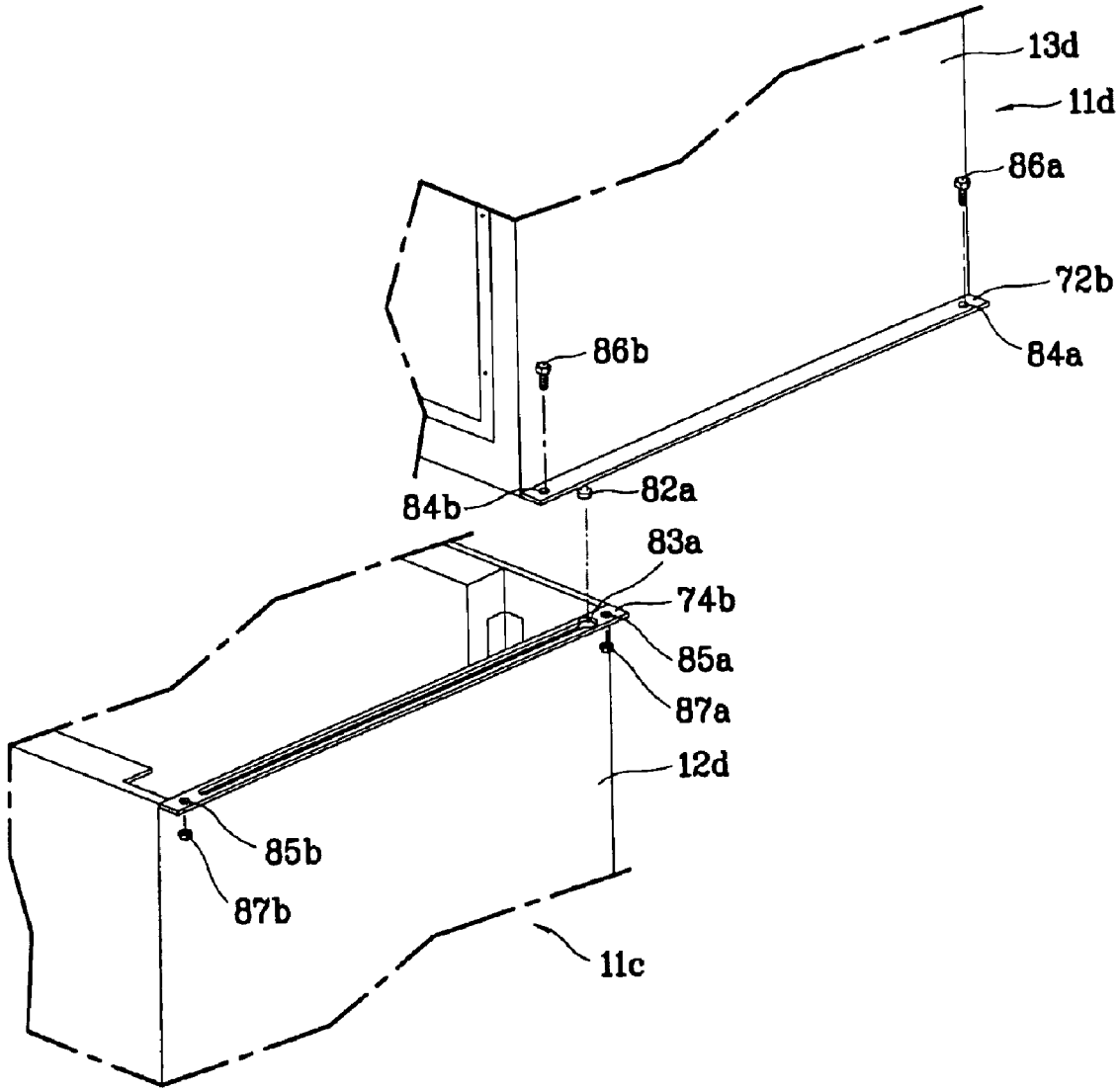
FIGS. 11A and 11B are partial perspective views illustrating a coupling member in accordance with third and fourth embodiments of the present invention.

FIG. 11A is a partial perspective view illustrating a coupling member in accordance with a third embodiment of the present invention. Referring to FIG. 11A, an external flange 72*b* is installed at one side of the side cover 13*d* formed on the bottom surface of the outdoor unit discharge casing 11*d*, the external flange 72*b* includes a hook 82*a* facing the top surface of the outdoor unit suction casing 11*c*, and openings 84*a* and 84*b* at its both ends, an external flange 74*b* is installed at one side of the side cover 12*d* formed on the top surface of the outdoor unit suction casing 11*c*, the external flange 74*b* includes a guide hole 83*a* which the hook 82*a* is inserted and slid into, and openings 85*a* and 85*b* corresponding to the openings 84*a* and 84*b*, and bolts 86*a* and 86*b* and nuts 87*a* and 87*b* connect the external flanges 72*b* and 74*b* through the openings 84*a*, 84*b*, 85*a* and 85*b*. The nuts 87*a* and 87*b* can be studs adhered to the external flange 74*b*.

Firstly, when the hook 82*a* and the guide hole 83*a* are coupled by the coupling member, the bottom surface of the outdoor unit discharge casing 11*d* and the top surface of the outdoor unit suction casing 11*c* are easily precisely connected. Thereafter, the outdoor unit suction casing 11*c* and the outdoor unit discharge casing 11*d* are coupled by coupling the bolts 86*a* and 86*b* and the nuts 87*a* and 87*b*, and thus external air sucked to the outdoor unit suction casing 11*c* is transmitted to the outdoor unit discharge casing 11*d*. They can be stably coupled after installation of the outdoor unit 100.

Figure 11B:
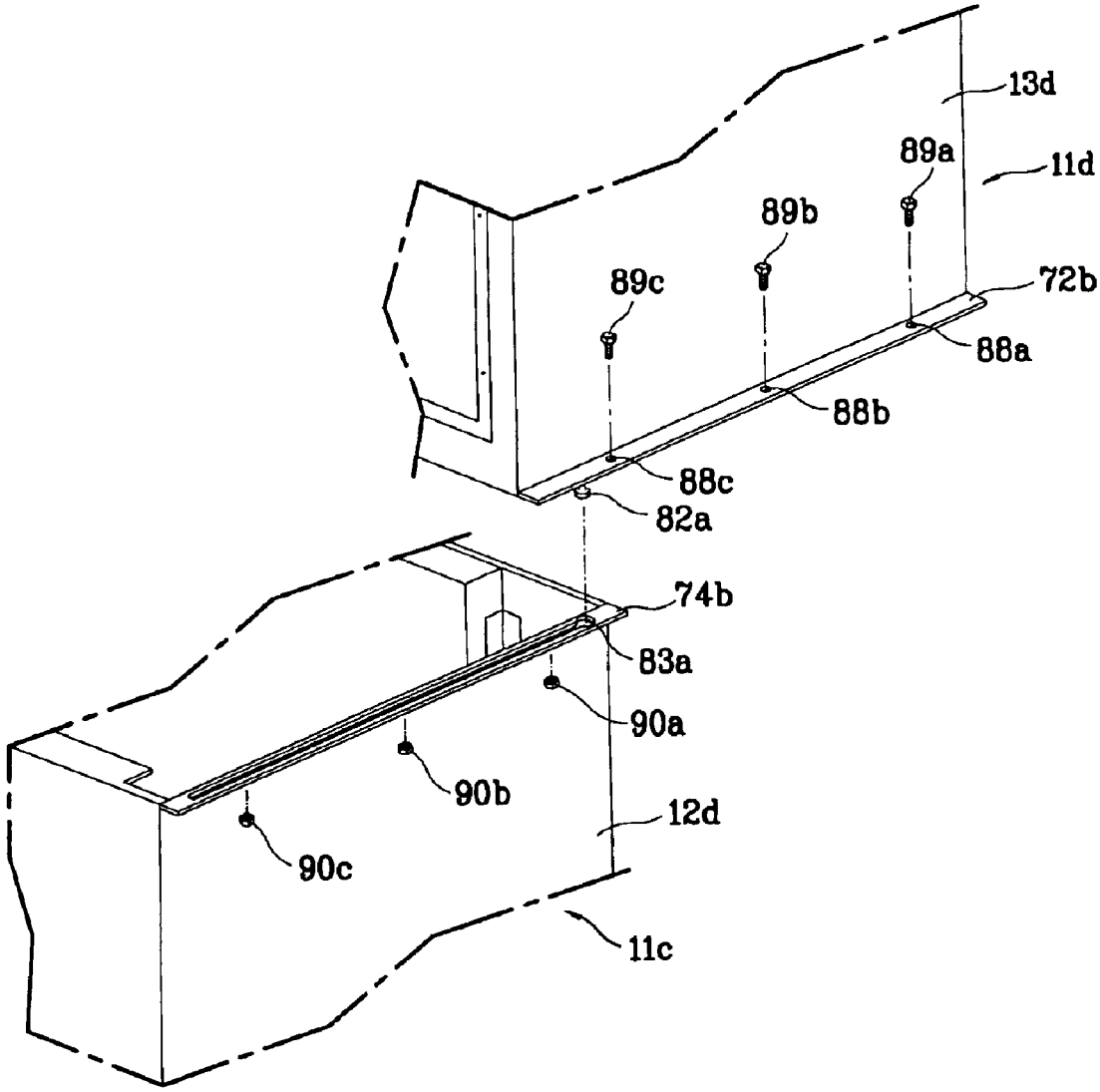

FIG. 11B is a partial perspective view illustrating a coupling member in accordance with a fourth embodiment of the present invention. As shown in FIG. 11B, an external flange 72*b* of the outdoor unit discharge casing 11*d* includes a hook 82*a* facing the top surface of the outdoor unit suction casing 11*c*, and a predetermined number of openings 88*a*, 88*b* and 88*c*, and an external flange 74*b* of the outdoor unit suction casing 11*c* includes a guide hole 83*a* which the hook 82*a* is inserted and slid into. Bolts 89*a*, 89*b* and 89*cb* and nuts 90*a*, 90*b* and 90*c* connect the external flanges 72*b* and 74*b* through the openings 88*a*, 88*b* and 88*c* and the guide hole 83*a*.

Here, the openings 88*a*, 88*b* and 88*c* are formed to correspond a rectangular hole of the guide hole 83*a*, and a diameter of the bolts 89*a*, 89*b* and 89*c* is equal to or smaller than a width of the rectangular hole of the guide hole 83*a*, so that the bolts 89*a*, 89*b* and 89*c* can pass through the rectangular hole of the guide hole 83*a*.

The outdoor unit including the coupling member of the fourth embodiment is separated and coupled in the same order as the outdoor unit including the coupling member of the third embodiment.

Figure 12:
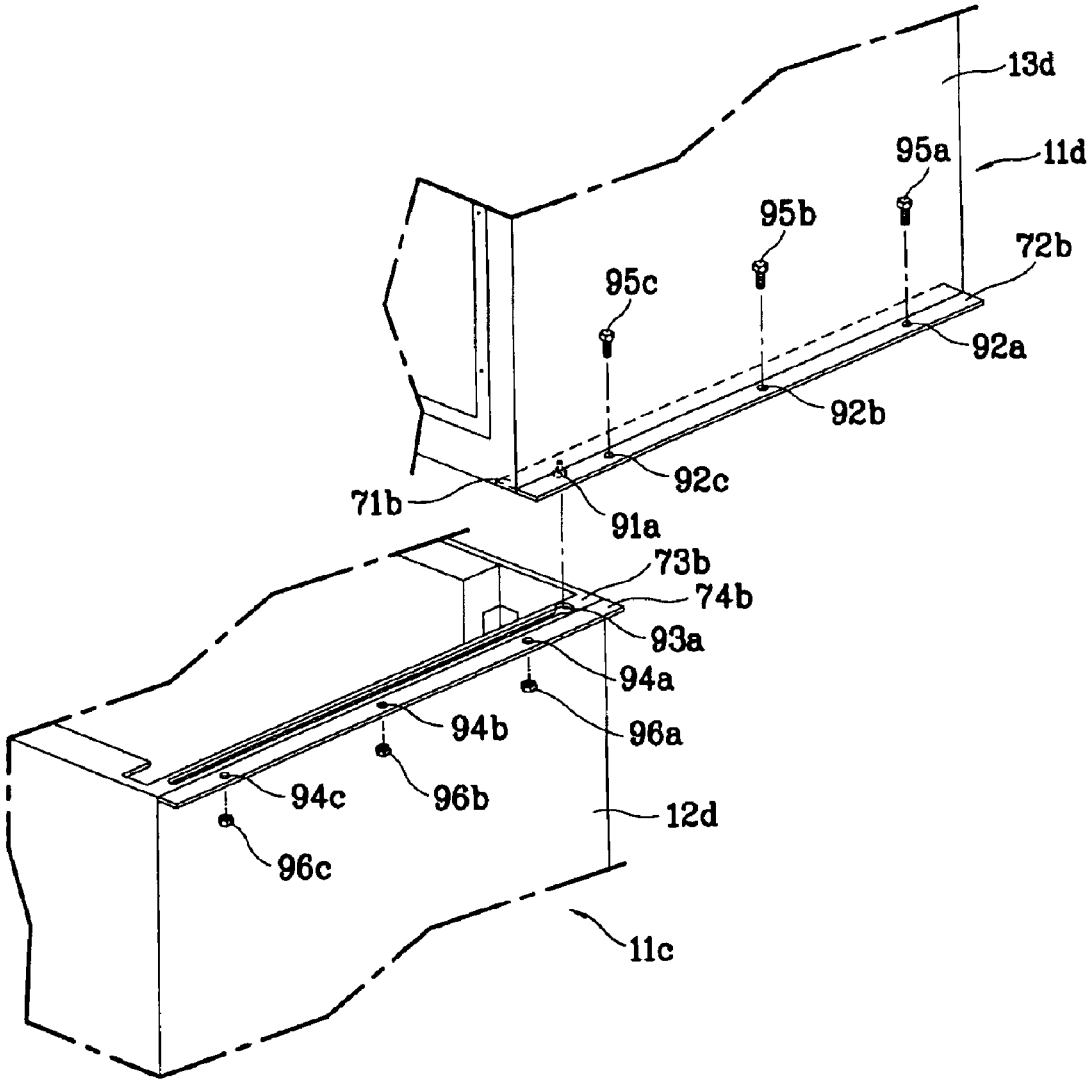
FIG. 12 is a partial perspective view illustrating a coupling member in accordance with a fifth embodiment of the present invention.

FIG. 12 is a partial perspective view illustrating a coupling member in accordance with a fifth embodiment of the present invention. As illustrated in FIG. 12, an internal flange 71*b* facing the inside and an external flange 72*b* facing the outside are installed at one side of the side cover 13*d* formed on the bottom surface of the outdoor unit discharge casing 11*d*, the internal flange 71*b* includes a hook 91 in the top surface direction of the outdoor unit suction casing 11*c*, and a predetermined number of openings 92*a*, 92*b* and 92*c*, an internal flange 73*b* facing the inside and an external flange 74*b* facing the outside are installed at one side of the side cover 12*d* formed on the top surface of the outdoor unit suction casing 11*c*, the internal flange 73*b* includes a guide hole 93*a* which the hook 91*a* is inserted and slid into, and openings 94*a*, 924 and 94*c* corresponding to the openings 92*a*, 92*b* and 92*c*, and bolts 95*a*, 95*b* and 95*c* and nuts 96*a*, 96*b* and 96*c* are coupled through the openings 92*a*, 92*b*, 92*c*, 94*a*, 94*b* and 94*c*.

The outdoor unit including the coupling member of the fifth embodiment is separated and coupled in the same order as the outdoor unit including the coupling member of the third embodiment.

Figure 13:
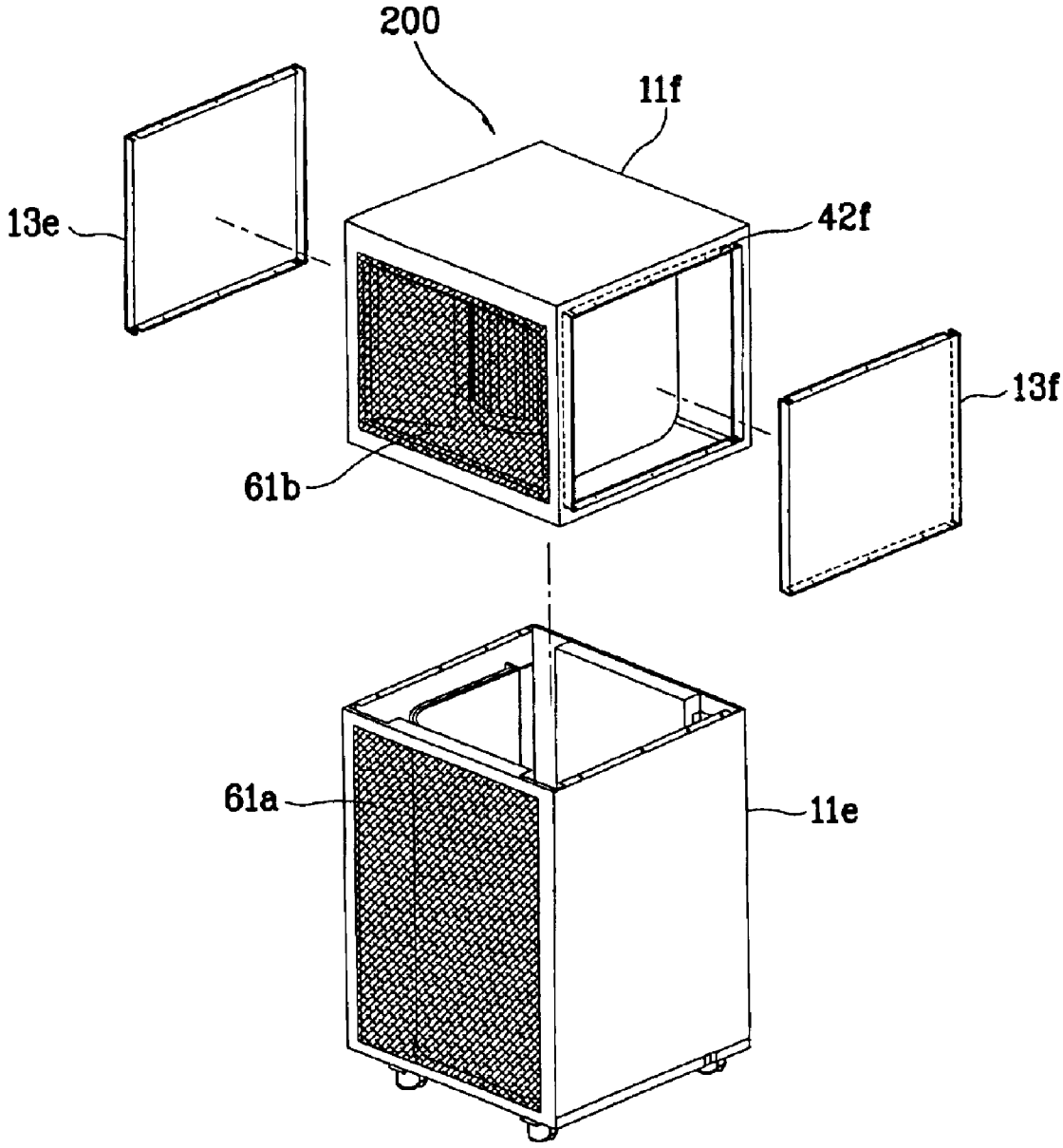
FIG. 13 is a state view illustrating separation of a front suction/discharge type outdoor unit for an air conditioner in accordance with a third embodiment of the present invention.

FIG. 13 is a state view illustrating separation of a front suction/discharge type outdoor unit for an air conditioner in accordance with a third embodiment of the present invention. Referring to FIG. 13, the outdoor unit 200 can be disassembled to an outdoor unit suction casing 1 e and an outdoor unit discharge casing 11*f*. The outdoor unit 200 include separable side separating covers 13*e* and 13*f* to open/close open holes 42*e* and 42*f* (42*e* is not shown) formed at the right and left sides of the outdoor unit discharge casing 11*f*. The outdoor unit 200 can have properties of the outdoor units 10 and 100 described above.

Figure 14A:
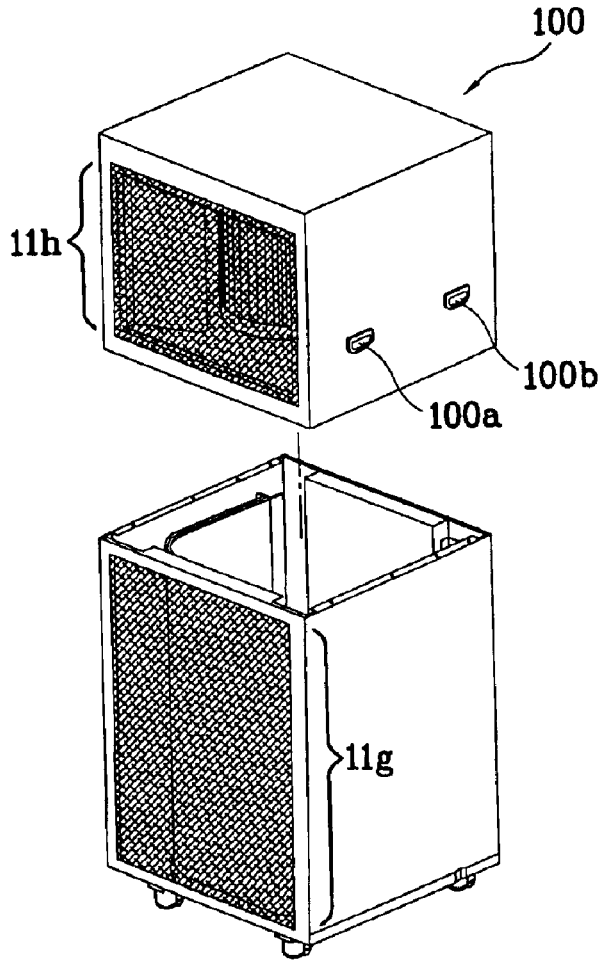
FIG. 14A is a state view illustrating separation of a front suction/discharge type outdoor unit for an air conditioner in accordance with a fourth embodiment of the present invention.

FIG. 14A is a state view illustrating separation of a front suction/discharge type outdoor unit for an air conditioner in accordance with a fourth embodiment of the present invention. As depicted in FIG. 14A, the outdoor unit includes an outdoor unit suction casing 11*g* and an outdoor unit discharge casing 11*h* which can be separated and coupled, and two handle members 100*a* to 100*d* (100*c* and 100*d* are not shown) are installed at two sides of the outdoor unit discharge casing 11*h* contacting one opened surface. When the user intends to position the outdoor unit discharge casing 11*h* on the outdoor unit suction casing 11*g* to couple them, the handle members 100*a* to 100*d* help the user to move and transfer the outdoor unit discharge casing 11*h*. Preferably, the handle members 100*a* to 100*d* are aligned at the lower ends of the two sides of the outdoor unit discharge casing 11*h* contacting one opened surface so that user can easily move and transfer it.

Figure 14B:
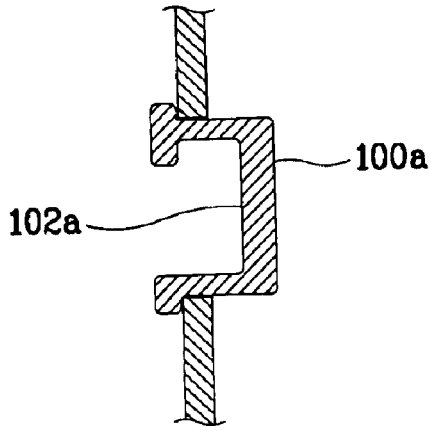
FIG. 14B is a cross-sectional view illustrating a handle member of FIG. 14A.

FIG. 14B is a cross-sectional view illustrating the handle member of FIG. 14A. As shown in FIG. 14B, the handle member 100*a* has a handle groove 102*a* which fingers of the user can be inserted into.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A front suction/discharge type compressor/condenser unit for an air conditioner, comprising:

a compressor/condenser unit suction casing having its one surface externally opened, and sucking external air for heat exchange; and a compressor/condenser unit discharge casing being separable and connectable to the compressor/condenser unit suction casing, sucking external air through the compressor/condenser unit suction casing, having its one surface externally opened, and discharging heat exchanged external air, wherein opened surfaces are respectively formed in the compressor/condenser unit suction casing and the compressor/condenser unit discharge casing to connect them to discharge the sucked external air.

2. The compressor/condenser unit of claim 1, wherein the compressor/condenser suction casing comprises the opened top surface, one opened surface, a closed bottom surface and three sides, and the compressor/condenser unit discharge casing comprises the opened bottom surface connected to the opened top surface of the compressor/condenser unit suction casing, one opened surface, a closed top surface and three sides.

3. The compressor/condenser unit of claim 2, wherein one opened surface of the compressor/condenser unit suction casing and one opened surface of the compressor/condenser unit discharge casing face the outside in the same direction.

4. The compressor/condenser unit of claim 2, further comprising a coupling member for coupling or separating the compressor/condenser unit suction casing to/from the compressor/condenser unit discharge casing.

5. The compressor/condenser unit of claim 4, wherein the coupling member comprises:

internal flanges protruded from the ends of at least two sides of the compressor/condenser unit suction casing and the compressor/condenser unit discharge casing to the inside of the compressor/condenser unit;

a hook formed on the surface of one internal flange; and a guide hole formed on the surface of the other internal flange.

6. The compressor/condenser unit of claim 5, wherein the guide hole comprises a circular hole which the hook is firstly inserted into, and a rectangular hole which the hook is slid into.

7. The compressor/condenser unit of claim 5, wherein the two sides of the compressor/condenser unit suction casing and the compressor/condenser unit discharge casing are not adjacent to each other.

8. The compressor/condenser unit of claim 5, wherein the coupling member further comprises:

external flanges being protruded from the ends of the sides where the internal flanges of the compressor/condenser unit suction casing and the compressor/condenser unit discharge casing have been formed to the outside of the compressor/condenser unit, and having a predetermined number of openings corresponding to each other; and bolts and nuts for connecting the compressor/condenser unit suction casing to the compressor/condenser unit discharge casing through the openings of the external flanges.

9. The compressor/condenser unit of claim 8, wherein the nuts are studs adhered to one of the surfaces of the external flanges of the compressor/condenser unit suction casing and the compressor/condenser unit discharge casing.

10. The compressor/condenser unit of claim 4, wherein the coupling member comprises:

external flanges being protruded from the ends of at least two sides of the compressor/condenser unit suction casing and the compressor/condenser unit discharge casing to the outside of the compressor/condenser unit, and having a predetermined number of openings corresponding to each other; and bolts and nuts for connecting the outdoor unit suction casing to the compressor/condenser unit discharge casing through the openings of the external flanges.

11. The compressor/condenser unit of claim 10, wherein the nuts are studs adhered to one of the surfaces of the external flanges of the compressor/condenser unit suction casing and the compressor/condenser unit discharge casing.

12. The compressor/condenser unit of claim 10, wherein the two sides of the compressor/condenser unit suction casing and the compressor/condenser unit discharge casing are not adjacent to each other.

13. The compressor/condenser unit of claim 4, wherein the coupling member comprises:

external flanges protruded from the ends of at least two sides of the compressor/condenser unit suction casing and the compressor/condenser unit discharge casing;

a hook formed on the surface of one external flange; and a guide hole formed on the surface of the other external flange.

14. The compressor/condenser unit of claim 13, wherein the guide hole comprises a circular hole which the hook is firstly inserted into, and a rectangular hole which the hook is slid into.

15. The compressor/condenser unit of claim 13, wherein the coupling member further comprises a screw for fastening the hook.

16. The compressor/condenser unit of claim 13, wherein the coupling member further comprises:

openings additionally formed on the external flange where the hook has been formed; and bolts and nuts for connecting the compressor/condenser unit suction casing to the compressor/condenser unit discharge casing through the openings and the guide hole.

17. The compressor/condenser unit of claim 16, wherein a width of the guide hole is equal to or greater than a diameter of the nut.

18. The compressor/condenser unit of claim 13, wherein the two sides of the compressor/condenser unit suction casing and the compressor/condenser unit discharge casing are not adjacent to each other.

19. The compressor/condenser unit of claim 13, wherein the coupling member further comprises:

openings formed on the external flanges to correspond to each other; and bolts and nuts for connecting the compressor/condenser unit suction casing to the compressor/condenser unit discharge casing through the openings.

20. The compressor/condenser unit of claim 19, wherein the nuts are studs adhered to one of the surfaces of the external flanges of the compressor/condenser unit suction casing and the compressor/condenser unit discharge casing.

21. The compressor/condenser unit of claim 1, wherein at least one surface of the compressor/condenser unit discharge casing comprises a side separating member connected from the outside to the inside of the compressor/condenser unit discharge casing.

22. The compressor/condenser unit of claim 21, wherein the side separating member comprises an open hole formed on the surface, and a side separating cover for opening/closing the open hole.

23. The compressor/condenser unit of claim 22, further comprising an insertion limiting member for inserting the side separating cover into the open hole at a predetermined depth.

24. The compressor/condenser unit of claim 23, wherein the insertion limiting member is a limiting plate formed at the inside of the open hole or the surface.

25. The compressor/condenser unit of claim 24, wherein the compressor/condenser unit discharge casing further comprises a cover coupling member for coupling the side separating cover to the surface where the open hole has been formed.

26. The compressor/condenser unit of claim 25, wherein the limiting plate comprises a predetermined number of openings, the side separating cover comprises openings corresponding to the openings of the limiting plate, and the cover coupling member comprises bolts and nuts for connecting the limiting plate to the side separating cover through the openings.

27. The compressor/condenser unit of claim 26, wherein the nuts are studs adhered to the rear surface of the limiting plate.

28. The compressor/condenser unit of claim 23, wherein the insertion limiting member is a flange formed on at least one side of the side separating cover.

29. The compressor/condenser unit of claim 28, wherein the surface comprises a predetermined number of openings adjacent to the open hole, the flange of the side separating cover comprises openings corresponding to the openings of the surface, and further comprising bolts and nuts for connecting the surface to the side separating cover through the openings.

30. The compressor/condenser unit of claim 29, wherein the nuts are studs adhered to the inside of the surface.

31. The compressor/condenser unit of claim 22, wherein the compressor/condenser unit discharge casing comprises a rotation coupling member for coupling the surface to one side of the side separating cover so that the side separating cover can rotate to open/close the open hole.

32. The compressor/condenser unit of claim 31, wherein the rotation coupling member is a first hinge device.

33. The compressor/condenser unit of claim 32, wherein the rotation coupling member further comprises a second hinge device.

34. The compressor/condenser unit of claim 31, wherein the rotation coupling member further comprises a fixing member for fixing the side separating cover to the surface so that the rotated side separating cover can close the open hole.

35. The compressor/condenser unit of claim 1, wherein handle members are respectively installed at the two sides of the compressor/condenser unit discharge casing contacting one surface.

36. The compressor/condenser unit of claim 35, wherein the handle members are installed at the lower ends of the two sides.

37. A front suction/discharge type compressor/condenser unit for an air conditioner, comprising a compressor/condenser unit casing having its one surface externally opened and its other surfaces closed, sucking external air for heat exchange, and discharging heat exchanged air through the one surface, at least one of the other surfaces of the compressor/condenser unit casing having a side separating member connecting the outside to the inside of the compressor/condenser unit casing, wherein the compressor/condenser unit casing is divided into a suction unit for sucking external air and a discharge unit for discharging heat exchanged external air, the open hole is formed on the surface surrounding the discharge unit, and the side separating cover opens/colses the surface of the discharge unit.

38. The compressor/condenser unit of claim 37, wherein the side separating member comprises an open hole formed on the surface, and a side separating cover for opening/closing the open hole.

39. The compressor/condenser unit of claim 38, further comprising an insertion limiting member for inserting the side separating cover into the open bole at a predetermined depth.

40. The compressor/condenser unit of claim 39, wherein the insertion limiting member is a limiting plate formed at the inside of the open hole or the surface.

41. The compressor/condenser unit of claim 39, wherein the insertion limiting member is a flange formed on at least one side of the side separating cover.

42. The compressor/condenser unit of claim 40, wherein the compressor/condenser unit casing further comprises a cover coupling member for coupling the side separating cover to the surface where the open hole has been formed.

43. The compressor/condenser unit of claim 42, wherein the limiting plate comprises a predetermined number of openings, the side separating cover comprises openings corresponding to the openings of the limiting plate, and the cover coupling member comprises bolts and nuts for connecting the limiting plate to the separating cover through the openings.

44. The compressor/condenser unit of claim 43, wherein the nuts are studs adhered to the rear surface of the limiting plate.

45. The compressor/condenser unit of claim 41, wherein the surface comprises a predetermined number of openings adjacent to the open hole, the flange of the side separating cover comprises openings corresponding to the openings of the surface, and further comprising bolts and nuts for connecting the surface to the side separating cover through the openings.

46. The compressor/condenser unit of claim 45, wherein the nuts are studs adhered to the inside of the surface.

47. The compressor/condenser unit of claim 38, wherein the compressor/condenser unit casing comprises a rotation coupling member for coupling the surface to one side of the side separating cover so that the side separating cover can rotate to open/close the open hole.

48. The compressor/condenser unit of claim 47, wherein the rotation coupling member is a first hinge device.

49. The compressor/condenser unit of claim 48, wherein the rotation coupling member further comprises a second hinge device.

50. The compressor/condenser unit of claim 48, wherein the rotation coupling member further comprises a fixing member for fixing the side separating cover to the surface so that the rotated side separating cover can close the open hole.

51. The compressor/condenser unit of claim 1, further comprising a precision coupling system for enabling the compressor/condenser unit discharge casing to be easily separated and connected to the compressor/condenser unit suction casing.

* * * * *